US010083642B2

(12) United States Patent
Yang et al.

(10) Patent No.: US 10,083,642 B2
(45) Date of Patent: Sep. 25, 2018

(54) DISPLAY APPARATUS AND DISPLAY DRIVING METHOD

(71) Applicant: Novatek Microelectronics Corp., Hsinchu (TW)

(72) Inventors: Hsueh-Yen Yang, Taoyuan (TW); Kai-Min Yang, Kaohsiung (TW); Feng-Ting Pai, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 306 days.

(21) Appl. No.: 14/708,289

(22) Filed: May 10, 2015

(65) Prior Publication Data

US 2016/0260369 A1 Sep. 8, 2016

(30) Foreign Application Priority Data

Mar. 3, 2015 (TW) ..... 104106644 A

(51) Int. Cl.
*G09G 3/20* (2006.01)

(52) U.S. Cl.
CPC ..... *G09G 3/20* (2013.01); *G09G 2300/0452* (2013.01); *G09G 2340/0407* (2013.01); *G09G 2340/0457* (2013.01)

(58) Field of Classification Search
CPC ..... G09G 3/20; G09G 2340/0407; G09G 2340/0457; G09G 2300/0452
See application file for complete search history.

(56) References Cited

U.S. PATENT DOCUMENTS 9,305,487 B2 4/2016 Yang et al.
2007/0103491 A1* 5/2007 Moriya ..... G02F 1/133514 345/694

(Continued)

FOREIGN PATENT DOCUMENTS

| | | |
|---|---|---|
| TW | I252465 | 4/2006 |
| TW | I417842 | 12/2013 |
| TW | I473074 | 2/2015 |

OTHER PUBLICATIONS

Qin et al., Priority Document for "Pixel structure, display panel and compensation method thereof" and English Abstract by Machine Translation, Oct. 27, 2014, pp. 1-20.*

(Continued)

*Primary Examiner* — Amr Awad
*Assistant Examiner* — Maheen Javed
(74) *Attorney, Agent, or Firm* — JCIPRNET

(57) ABSTRACT

A display apparatus including a display panel and a display driver is provided. The display panel includes a sub-pixel repeat array. The sub-pixel repeat array is repeatedly arranged to form a pixel array on the display panel. The pixel array includes at least one map display unit. The display driver is coupled to the display panel. The display driver drives the display panel to display an image by using a sub-pixel rendering method. The image includes at least one specified intensity map. The map display unit includes a center sub-pixel unit and a plurality of neighboring sub-pixel units. The specified intensity map includes one or more white pixel points. In the map display unit, luminance summations of sub-pixels of different colors are equal. Furthermore, a display driving method is also provided.

23 Claims, 13 Drawing Sheets

(56) References Cited

U.S. PATENT DOCUMENTS

| | | | | |
|---|---|---|---|---|
| 2012/0139965 | A1* | 6/2012 | Yang | G09G 3/3225 345/690 |
| 2014/0204008 | A1 | 7/2014 | Chu-Ke et al. | |
| 2015/0130868 | A1* | 5/2015 | Feng | G09G 3/2003 345/694 |
| 2016/0117969 | A1* | 4/2016 | Qin | G09G 3/2003 345/694 |
| 2016/0155416 | A1* | 6/2016 | Lee | G09G 3/2003 345/690 |

OTHER PUBLICATIONS

"Office Action of Taiwan Counterpart Application," dated May 11, 2016, p. 1-p. 4.

* cited by examiner

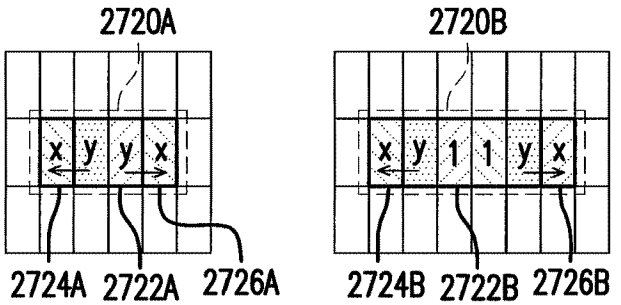
FIG. 27A
FIG. 27B
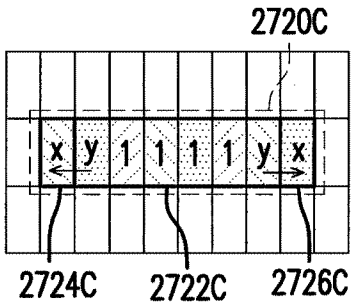
FIG. 27C
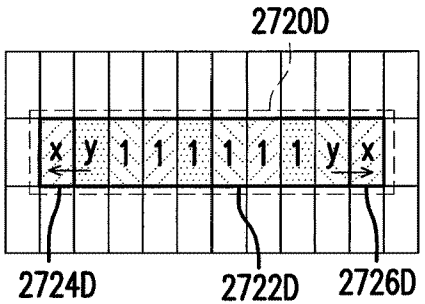
FIG. 27D
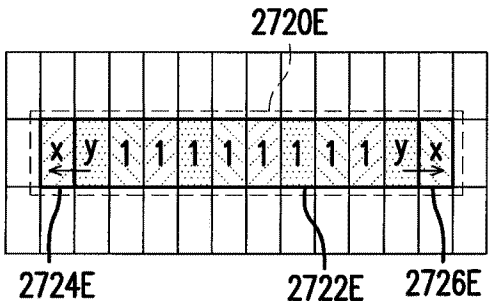
FIG. 27E
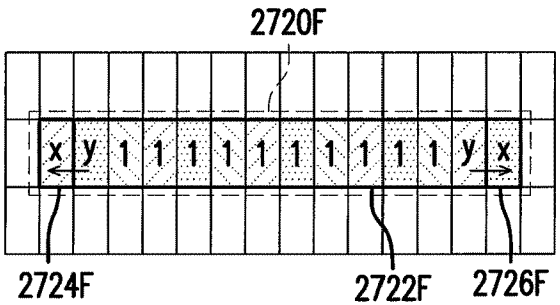
FIG. 27F

DISPLAY APPARATUS AND DISPLAY DRIVING METHOD

CROSS-REFERENCE TO RELATED APPLICATION

This application claims the priority benefit of Taiwan application serial no. 104106644, filed on Mar. 3, 2015. The entirety of the above-mentioned patent application is hereby incorporated by reference herein and made a part of this specification.

BACKGROUND

Technical Field

The invention relates to an electronic apparatus and a driving method of the electronic apparatus, and particularly relates to a display apparatus and a display driving method.

Related Art

Along with quick development of display technology, current market requirements for display panel performance have a trend of high resolution, high brightness and low power consumption, etc. However, along with increase of the resolution of the display panel, in order to display a high resolution, the number of sub-pixels on the display panel is also increased, so that manufacturing cost of the display panel is increased. In order to decrease the manufacturing cost of the display panel, a sub-pixel rending method (SPR method) is developed. A display apparatus applies different sub-pixel arrangements and designs to implement an appropriate algorithm, so that the resolution of the display panel displaying an image can be enhanced to a sub-pixel resolution. Since a size of the sub-pixel is smaller than that of a pixel, the resolution of the image perceived by human eyes (i.e. a visual resolution) is enhanced. Moreover, when the resolution of the display panel is gradually increased, a display driver can adopt different rates to write pixel data into the display panel to display images, so as to ameliorate a light transmittance of the display panel under the same manufacturing conditions. However, when the display driver adopts different rates to write the pixel data into the display panel, if the display panel can continually provide a good display quality, a good user experience is achieved.

SUMMARY

The invention is directed to a display apparatus and a display driving method, by which display quality of a display panel is improved.

The invention provides a display apparatus including a display panel and a display driver. The display panel includes a rectangular sub-pixel repeat array. The sub-pixel repeat array is repeatedly arranged to form a pixel array on the display panel. The pixel array includes at least one map display unit. The map display unit includes a center sub-pixel unit and a plurality of neighboring sub-pixel units. The display driver is coupled to the display panel. The display driver drives the display panel to display an image by using a sub-pixel rendering method. The image includes at least one specified intensity map. The map display unit displays the specified intensity map. A first color sub-pixel, a second color sub-pixel and a third color sub-pixel are sequentially arranged along a horizontal direction to form a first sub-pixel row of the sub-pixel repeat array. The third color sub-pixel, the first color sub-pixel and the second color sub-pixel are sequentially arranged along the horizontal direction to form a second sub-pixel row of the sub-pixel repeat array. The map display unit includes a center sub-pixel unit and a plurality of neighboring sub-pixel units. The specified intensity map includes one or more white pixel points. In the map display unit, a luminance summation of the first color sub-pixel, a luminance summation of the second color sub-pixel and a luminance summation of the third color sub-pixel are equal.

In an embodiment of the invention, the center sub-pixel unit and the neighboring sub-pixel units are arranged adjacent to each other along a vertical direction while taking the center sub-pixel unit as a center.

In an embodiment of the invention, the display driver writes pixel data into the pixel array according to a data mapping method of a first rate.

In an embodiment of the invention, the center sub-pixel unit includes the first color sub-pixel and the second color sub-pixel. Each of the neighboring sub-pixel units includes the third color sub-pixel. The center sub-pixel unit displays a first color or a second color, the display driver drives the center sub-pixel unit to display the specified intensity map, and a luminance of the center sub-pixel unit is greater than a luminance summation of the neighboring sub-pixel units. The center sub-pixel unit displays a third color, the display driver drives the neighboring sub-pixel units to display the specified intensity map, and the luminance of the center sub-pixel unit is smaller than the luminance summation of the neighboring sub-pixel units.

In an embodiment of the invention, the center sub-pixel unit includes the third color sub-pixel, each of the neighboring sub-pixel units includes the first color sub-pixel and the second color sub-pixel, the center sub-pixel unit displays a first color or a second color, the display driver drives the neighboring sub-pixel units to display the specified intensity map, and a luminance of the center sub-pixel unit is smaller than a luminance summation of the neighboring sub-pixel units, and the center sub-pixel unit displays a third color, the display driver drives the center sub-pixel unit to display the specified intensity map, and the luminance of the center sub-pixel unit is greater than the luminance summation of the neighboring sub-pixel units.

In an embodiment of the invention, when the map display unit displays one white pixel point, the specified intensity map of the map display unit is complied with a first equation, when the map display unit displays 2m white pixel points, the specified intensity map of the map display unit is complied with a second equation, and when the map display unit displays 2m+1 white pixel points, the specified intensity map of the map display unit is complied with a third equation, where m is a positive integer greater than 0.

In an embodiment of the invention, the center sub-pixel unit and the neighboring sub-pixel units are arranged adjacent to each other along the horizontal direction while taking the center sub-pixel unit as a center.

In an embodiment of the invention, the display driver writes pixel data into the pixel array according to a data mapping method of a second rate.

In an embodiment of the invention, the center sub-pixel unit includes the first color sub-pixel and the second color sub-pixel. Each of the neighboring sub-pixel units includes the third color sub-pixel. The center sub-pixel unit displays a first color or a second color, the display driver drives the center sub-pixel unit to display the specified intensity map, and a luminance of the center sub-pixel unit is greater than a luminance summation of the neighboring sub-pixel units. The center sub-pixel unit displays a third color, the display driver drives the neighboring sub-pixel units to display the specified intensity map, and the luminance of the center sub-pixel unit is smaller than the luminance summation of the neighboring sub-pixel units.

In an embodiment of the invention, the center sub-pixel unit includes the first color sub-pixel and the third color sub-pixel, each of the neighboring sub-pixel units includes the second color sub-pixel, the center sub-pixel unit displays a first color or a third color, the display driver drives the center sub-pixel unit to display the specified intensity map, and a luminance of the center sub-pixel unit is greater than a luminance summation of the neighboring sub-pixel units. The center sub-pixel unit displays a second color, the display driver drives a neighboring sub-pixel unit neighbored to the third color sub-pixel in the neighboring sub-pixel units to display the specified intensity map, and the luminance of the center sub-pixel unit is smaller than a luminance of the neighboring sub-pixel unit neighbored to the third color sub-pixel.

In an embodiment of the invention, the center sub-pixel unit includes the second color sub-pixel and the third color sub-pixel. Each of the neighboring sub-pixel units includes the first color sub-pixel. The center sub-pixel unit displays a first color, the display driver drives a neighboring sub-pixel unit neighbored to the third color sub-pixel in the neighboring sub-pixel units to display the specified intensity map, and a luminance of the center sub-pixel unit is smaller than a luminance of the neighboring sub-pixel unit neighbored to the third color sub-pixel, and the center sub-pixel unit displays a second color or a third color, the display driver drives the center sub-pixel unit to display the specified intensity map, and the luminance of the center sub-pixel unit is greater than a luminance summation of the neighboring sub-pixel units.

In an embodiment of the invention, when the map display unit displays 3k+1 white pixel points, the specified intensity map of the map display unit is complied with a first equation, when the map display unit displays 3k+2 white pixel points, the specified intensity map of the map display unit is complied with a fourth equation, and when the map display unit displays 3k+3 white pixel points, the specified intensity map of the map display unit is complied with a second equation, where k is a positive integer greater than or equal to 0.

In an embodiment of the invention, the center sub-pixel unit displays a white color, the display driver drives the center sub-pixel unit and the neighboring sub-pixel units to operate in collaboration to display the specified intensity map, and a luminance of the center sub-pixel unit is greater than or equal to a luminance summation of the neighboring sub-pixel units.

In an embodiment of the invention, the neighboring sub-pixel units include a first sub-pixel unit and a second sub-pixel unit. The display driver determines an edge relationship of the map display unit according to the pixel data written into the center sub-pixel unit, the first sub-pixel unit and the second sub-pixel unit and an edge threshold.

In an embodiment of the invention, after determination, if a data difference between the center sub-pixel unit and the first sub-pixel unit is greater than the edge threshold, the display driver drives the center sub-pixel unit and the first sub-pixel unit to display the specified intensity map.

In an embodiment of the invention, after determination, if a data difference between the center sub-pixel unit and the second sub-pixel unit is greater than the edge threshold, the display driver drives the center sub-pixel unit and the second sub-pixel unit to display the specified intensity map.

In an embodiment of the invention, after determination, if a data difference between the center sub-pixel unit and the first sub-pixel unit is greater than the edge threshold, and a data difference between the center sub-pixel unit and the second sub-pixel unit is greater than the edge threshold, the display driver drives the center sub-pixel unit, the first sub-pixel unit and the second sub-pixel unit to display the specified intensity map.

In an embodiment of the invention, after determination, if a data difference between the center sub-pixel unit and the first sub-pixel unit is greater than the edge threshold, a data difference between the center sub-pixel unit and the second sub-pixel unit is greater than the edge threshold, the pixel data of the center sub-pixel unit is smaller than the pixel data of the first sub-pixel unit, and the pixel data of the center sub-pixel unit is smaller than the pixel data of the second sub-pixel unit, the display driver drives the first sub-pixel unit and the second sub-pixel unit to display the specified intensity map.

In an embodiment of the invention, the center sub-pixel unit includes the third color sub-pixel. After determination, if a data difference between the center sub-pixel unit and the first sub-pixel unit is greater than the edge threshold, the display driver drives the center sub-pixel unit and the second sub-pixel unit to display the specified intensity map.

In an embodiment of the invention, the center sub-pixel unit includes the third color sub-pixel. After determination, if a data difference between the center sub-pixel unit and the second sub-pixel unit is greater than the edge threshold, the display driver drives the center sub-pixel unit and the first sub-pixel unit to display the specified intensity map.

In an embodiment of the invention, the first color sub-pixel and the third color sub-pixel are sequentially arranged along a vertical direction to form a first sub-pixel column of the sub-pixel repeat array, the second color sub-pixel and the first color sub-pixel are sequentially arranged along the vertical direction to form a second sub-pixel column of the sub-pixel repeat array, and the third color sub-pixel and the second color sub-pixel are sequentially arranged along the vertical direction to form a third sub-pixel column of the sub-pixel repeat array.

In an embodiment of the invention, the first color sub-pixel, the second color sub-pixel and the third color sub-pixel are respectively a blue sub-pixel, a red sub-pixel and a green sub-pixel.

The invention provides a display driving method, which is adapted to drive a display panel to display an image by using a sub-pixel rendering method. The display panel includes a pixel array. The pixel array includes at least one map display unit. The image includes at least one specified intensity map. The display driving method includes following steps. An edge threshold is set. An edge relationship of the map display unit is determined according to pixel data written into the map display unit and the edge threshold. A center sub-pixel unit and a plurality of neighboring sub-pixel units in the map display unit are driven according to the edge relationship, so as to display the specified intensity map. The neighboring sub-pixel units include a first sub-pixel unit and a second sub-pixel unit. The center sub-pixel unit, the first sub-pixel unit and the second sub-pixel unit are arranged adjacent to each other along a horizontal direction or a vertical direction while taking the center sub-pixel unit as a center. The specified intensity map includes one or more white pixel points. In the map display unit, a luminance summation of the first color sub-pixel, a luminance summation of the second color sub-pixel and a luminance summation of the third color sub-pixel are equal.

In an embodiment of the invention, after determination, if a data difference between the center sub-pixel unit and the first sub-pixel unit is greater than the edge threshold, the aforementioned step of driving the center sub-pixel unit and the neighboring sub-pixel units in the map display unit according to the edge relationship includes driving the center sub-pixel unit and the first sub-pixel unit to display the specified intensity map.

In an embodiment of the invention, after determination, if a data difference between the center sub-pixel unit and the second sub-pixel unit is greater than the edge threshold, the aforementioned step of driving the center sub-pixel unit and the neighboring sub-pixel units in the map display unit according to the edge relationship includes driving the center sub-pixel unit and the second sub-pixel unit to display the specified intensity map.

In an embodiment of the invention, after determination, if a data difference between the center sub-pixel unit and the first sub-pixel unit is greater than the edge threshold, and a data difference between the center sub-pixel unit and the second sub-pixel unit is greater than the edge threshold, the aforementioned step of driving the center sub-pixel unit and the neighboring sub-pixel units in the map display unit according to the edge relationship includes driving the center sub-pixel unit, the first sub-pixel unit and the second sub-pixel unit to display the specified intensity map.

In an embodiment of the invention, after determination, if a data difference between the center sub-pixel unit and the first sub-pixel unit is greater than the edge threshold, a data difference between the center sub-pixel unit and the second sub-pixel unit is greater than the edge threshold, the pixel data of the center sub-pixel unit is smaller than the pixel data of the first sub-pixel unit, and the pixel data of the center sub-pixel unit is smaller than the pixel data of the second sub-pixel unit, the aforementioned step of driving the center sub-pixel unit and the neighboring sub-pixel units in the map display unit according to the edge relationship includes driving the first sub-pixel unit and the second sub-pixel unit to display the specified intensity map.

In an embodiment of the invention, the center sub-pixel unit includes a specific color sub-pixel. After determination, if a data difference between the center sub-pixel unit and the first sub-pixel unit is greater than the edge threshold, the aforementioned step of driving the center sub-pixel unit and the neighboring sub-pixel units in the map display unit according to the edge relationship includes driving the center sub-pixel unit and the second sub-pixel unit to display the specified intensity map.

In an embodiment of the invention, the center sub-pixel unit includes a specific color sub-pixel. After determination, if a data difference between the center sub-pixel unit and the second sub-pixel unit is greater than the edge threshold, the aforementioned step of driving the center sub-pixel unit and the neighboring sub-pixel units in the map display unit according to the edge relationship includes driving the center sub-pixel unit and the first sub-pixel unit to display the specified intensity map.

In an embodiment of the invention, the center sub-pixel unit, the first sub-pixel unit and the second sub-pixel unit are arranged adjacent to each other along a vertical direction while taking the center sub-pixel unit as a center.

In an embodiment of the invention, the display driving method further includes writing the pixel data into the pixel array according to a data mapping method of a first rate.

In an embodiment of the invention, when the map display unit displays one white pixel point, the specified intensity map of the map display unit is complied with a first equation, when the map display unit displays 2m white pixel points, the specified intensity map of the map display unit is complied with a second equation, and when the map display unit displays 2m+1 white pixel points, the specified intensity map of the map display unit is complied with a third equation, where m is a positive integer greater than 0.

In an embodiment of the invention, the center sub-pixel unit, the first sub-pixel unit and the second sub-pixel unit are arranged adjacent to each other along the horizontal direction while taking the center sub-pixel unit as a center.

In an embodiment of the invention, the display driving method further includes writing the pixel data into the pixel array according to a data mapping method of a second rate.

In an embodiment of the invention, when the map display unit displays 3k+1 white pixel points, the specified intensity map of the map display unit is complied with a first equation, when the map display unit displays 3k+2 white pixel points, the specified intensity map of the map display unit is complied with a fourth equation, and when the map display unit displays 3k+3 white pixel points, the specified intensity map of the map display unit is complied with a second equation, where k is a positive integer greater than or equal to 0.

According to the above descriptions, in the exemplary embodiments of the invention, the display driver drives the map display unit according to the edge relationship of the map display unit, such that at least one of the center sub-pixel unit and the neighboring sub-pixel units displays the specified intensity map, so as to improve the display quality of the display panel.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

FIG. 27A to FIG. 27F are schematic diagrams of map display units of different embodiments of the invention.

DETAILED DESCRIPTION OF DISCLOSED EMBODIMENTS

Figure 1:
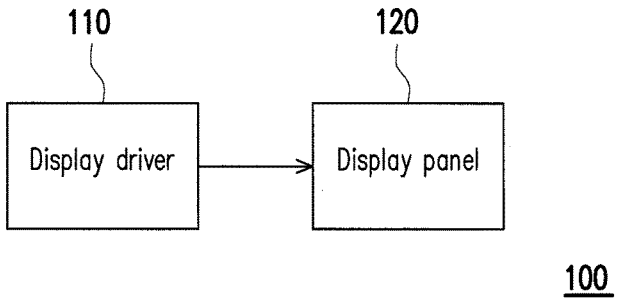
FIG. 1 is a schematic diagram of a display apparatus according to an embodiment of the invention.

FIG. 1 is a schematic diagram of a display apparatus according to an embodiment of the invention. Referring to FIG. 1, the display apparatus 100 of the present embodiment includes a display driver 110 and a display panel 120. The display driver 110 is coupled to the display panel 120. The display driver 110 drives the display panel 120 to display images according to a sub-pixel rendering method. In the present embodiment, the display panel 120 includes a pixel array (not shown). The pixel array includes at least one map display unit configured to display at least one specified intensity map of the image.

Figure 2:
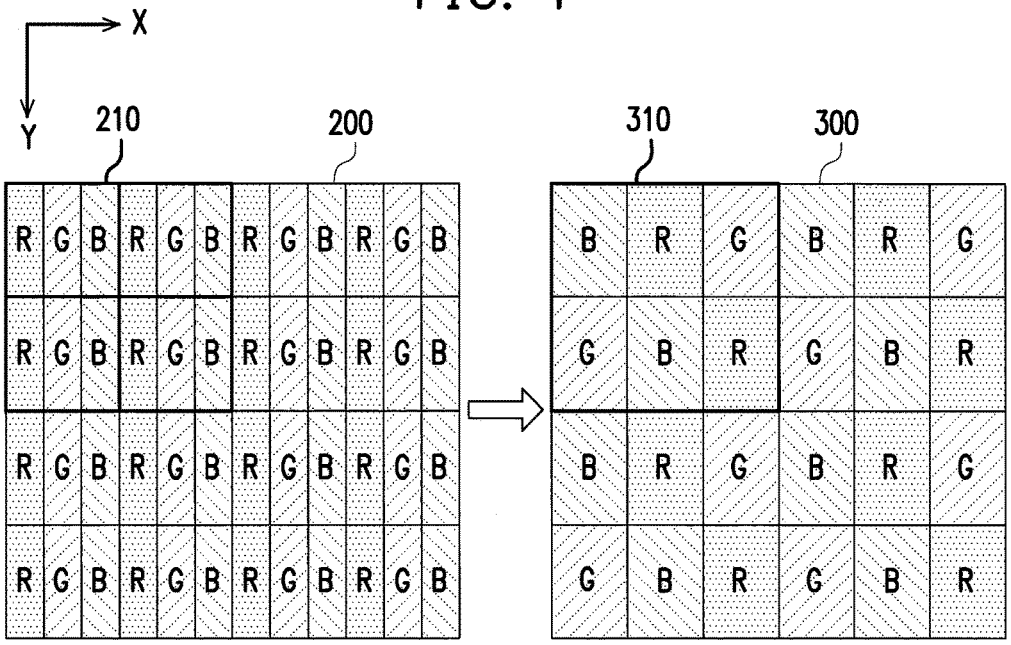
FIG. 2 is a schematic diagram of a pixel array and pixel data written into the pixel array according to an embodiment of the invention.
Figure 3:
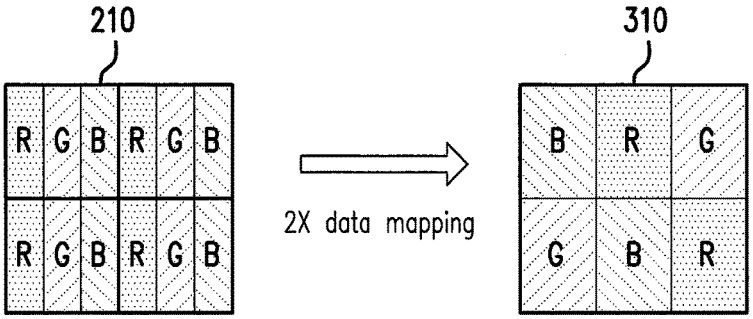
FIG. 3 is a schematic diagram of a sub-pixel repeat array of FIG. 2 and pixel data written into the sub-pixel repeat array.

To be specific, FIG. 2 is a schematic diagram of the pixel array and pixel data written into the pixel array according to an embodiment of the invention. FIG. 3 is a schematic diagram of a sub-pixel repeat array of FIG. 2 and pixel data written into the sub-pixel repeat array according to an embodiment of the invention. Referring to FIG. 1 to FIG. 3, in the present embodiment, the display driver 110, for example, writes pixel data 200 into the pixel array 300 to drive the display panel 120 to display an image. Moreover, the pixel array 300 of the present embodiment is, for example, a part of or all of the pixel array arranged on the display panel 120 of FIG. 1, and a sub-pixel repeat unit 310 is repeatedly arranged to form the pixel array 300. In the embodiment of FIG. 2, a pixel data array with a dimension of 4×4 is used to represent the pixel data 200, and the pixel data 200 is written into the pixel array 300 with a pixel width the same with that of the pixel data 200, though the invention is not limited thereto. The dimension of the pixel data 200 and the whole pixel with of the pixel array 300 of the present embodiment are not used for limiting the invention.

In the present embodiment, the display driver 110, for example, writes the pixel data 210 with a dimension of 2×2 into the sub-pixel repeat unit 310 in a 2X data mapping method. To be specific, the sub-pixel repeat unit 310 of the present embodiment is a rectangular sub-pixel array, which has two sub-pixel rows along a horizontal direction X, and has three sub-pixel columns along a vertical direction Y, and the sub-pixels of each sub-pixel column are not misaligned. In the present embodiment, the sub-pixel repeat unit 310 includes first color sub-pixels, second color sub-pixels and third color sub-pixels, which are, for example, respectively blue sub-pixels, red sub-pixels and green sub-pixels, as shown in FIG. 3. In the present embodiment, the first color sub-pixel, the second color sub-pixel and the third color sub-pixel are sequentially arranged along the horizontal direction X from the left to the right to form a first sub-pixel row of the sub-pixel repeat unit 310. The third color sub-pixel, the first color sub-pixel and the second color sub-pixel are sequentially arranged along the horizontal direction X to form a second sub-pixel row of the sub-pixel repeat unit 310. In the present embodiment, the first color sub-pixel and the third color sub-pixel are sequentially arranged along the vertical direction Y from the top to the bottom to form a first sub-pixel column of the sub-pixel repeat unit 310. The second color sub-pixel and the first color sub-pixel are sequentially arranged along the vertical direction Y from the top to the bottom to form a second sub-pixel column of the sub-pixel repeat unit 310. The third color sub-pixel and the second color sub-pixel are sequentially arranged along the vertical direction Y from the top to the bottom to form a third sub-pixel column of the sub-pixel repeat unit 310, as shown in FIG. 3.

Figure 4:
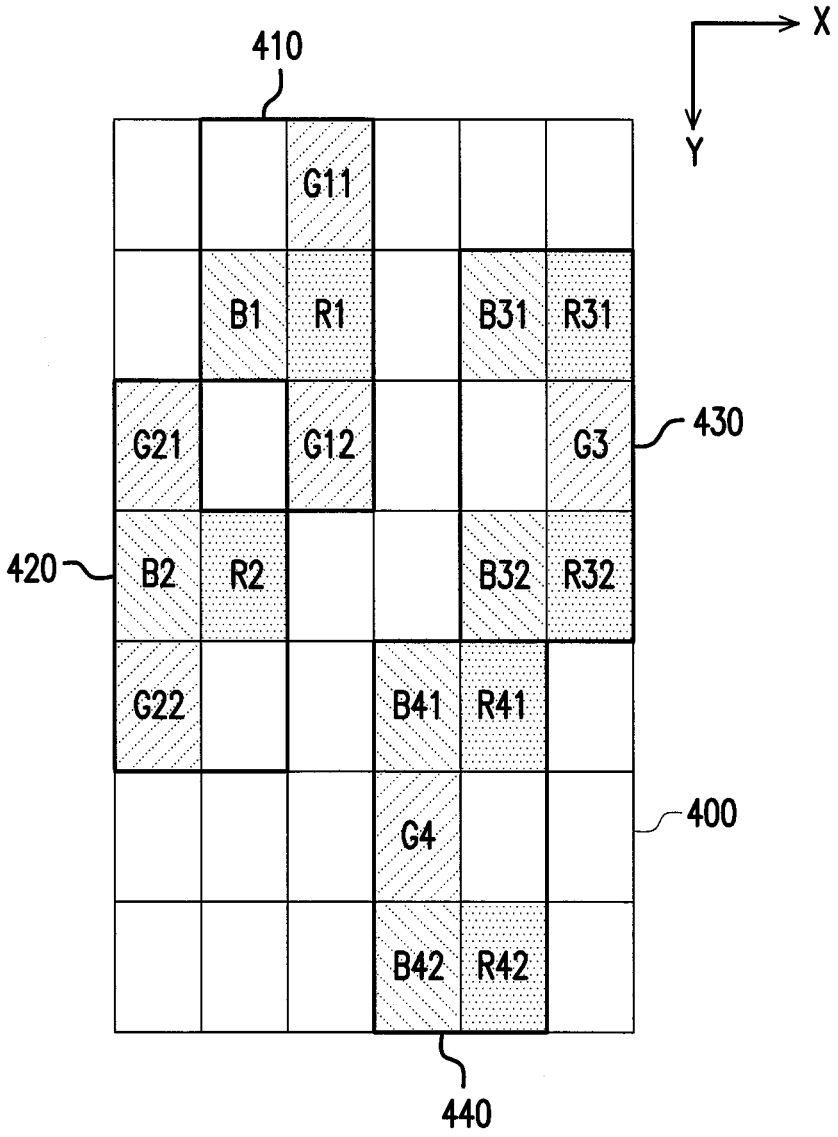
FIG. 4 is a schematic diagram of a pixel array according to another embodiment of the invention.

FIG. 4 is a schematic diagram of a pixel array according to another embodiment of the invention. Referring to FIG. 1 to FIG. 4, the pixel array 400 of the present embodiment is, for example, formed by repeatedly arranging the sub-pixel repeat unit 310 of FIG. 3, which is, for example, a part of or all of the pixel array arranged on the display panel 120 of FIG. 1. In the present embodiment, the display driver 110, for example, writes pixel data into the pixel array 400 in the 2X data mapping method. The pixel array 400 includes a plurality of map display units 410-440 configured to display at least one specified intensity map of the image.

To be specific, taking the map display unit 410 as an example, the map display unit 410 includes a center sub-pixel unit B1, R1 and a plurality of neighboring sub-pixel units G11 and G12. The center sub-pixel unit B1, R1 and the neighboring sub-pixel units G11 and G12 are arranged adjacent to each other along the Y-direction while taking the center sub-pixel unit B1, R1 as a center. In this example, the center sub-pixel unit B1, R1 includes a first color sub-pixel B1 and a second color sub-pixel R1. Each of the neighboring sub-pixel units G11 and G12 includes a single third color sub-pixel G11 or G12. In the map display unit 410, the sub-pixels G11, R1 and G12 are sequentially arranged in a same sub-pixel column from the top to the bottom. In the present embodiment, the display driver 110 drivers the map display unit 410 to make at least one of the center sub-pixel unit B1, R1 and the neighboring sub-pixel units G11 and G12 to display the specified intensity map of the image. For example, in an embodiment, the specified intensity map is that each of the neighboring sub-pixel units G11 and G12 respectively display a luminance of 40%-60% when the luminance displayed by the center sub-pixel unit B1, R1 is 100%, and a luminance summation of the neighboring sub-pixel units G11 and G12 is substantially 100%. Moreover, the arrangement and operation method of the sub-pixels of the map display unit 420 can be deduced by analogy, where the sub-pixels G21, B2 and G22 of the map display unit 420 are sequentially arranged in a same sub-pixel column from the top to the bottom.

Taking the map display unit 430 as an example, the map display unit 430 includes a center sub-pixel unit G3 and neighboring sub-pixel units B31, R31 and neighboring sub-pixel units B32 and R32. The center sub-pixel unit G3, the neighboring sub-pixel units B31, R31 and the neighboring sub-pixel units B32 and R32 are arranged adjacent to each other along the Y-direction while taking the center sub-pixel unit G3 as a center. In this example, the center sub-pixel unit G3 includes a single third color sub-pixel G3. The neighboring sub-pixel units B31 and R31 include a first color sub-pixel B31 and a second color sub-pixel R31. The neighboring sub-pixel units B32 and R32 include a first color sub-pixel B32 and a second color sub-pixel R32. In the map display unit 430, the sub-pixels R31, G3 and R32 are sequentially arranged in a same sub-pixel column from the top to the bottom. In the present embodiment, the display driver 110 drivers the map display unit 430 to make at least one of the center sub-pixel unit G3, the neighboring sub-pixel units B31 and R31 and the neighboring sub-pixel units B32 and R32 to display the specified intensity map of the image. For example, in an embodiment, the specified intensity map is that each of the neighboring sub-pixel units B31 and R31 and the neighboring sub-pixel units B32 and R32 respectively display a luminance of 40%-60% when the luminance displayed by the center sub-pixel unit G3 is 100%, and luminance summations of the neighboring sub-pixel units B31 and R31 and the neighboring sub-pixel units B32 and R32 are substantially 100%. For example, the neighboring sub-pixel units B31 and R31 display a luminance of 50%, and the neighboring sub-pixel units B32 and R32 also display a luminance of 50%. Moreover, the arrangement and operation method of the sub-pixels of the map display unit 440 can be deduced by analogy, where the sub-pixels B41, G4 and B42 of the map display unit 440 are sequentially arranged in a same sub-pixel column from the top to the bottom.

In the present embodiment, according to the arrangement and operation method of the sub-pixels of each of the map display units, when an observer observes the specified intensity map, a visual center thereof approximately focuses on the center of each of the specified intensity maps. Moreover, in each of the specified intensity maps, the luminance of the center sub-pixel unit is substantially equal to the luminance summation of the neighboring sub-pixel units.

Figure 5:
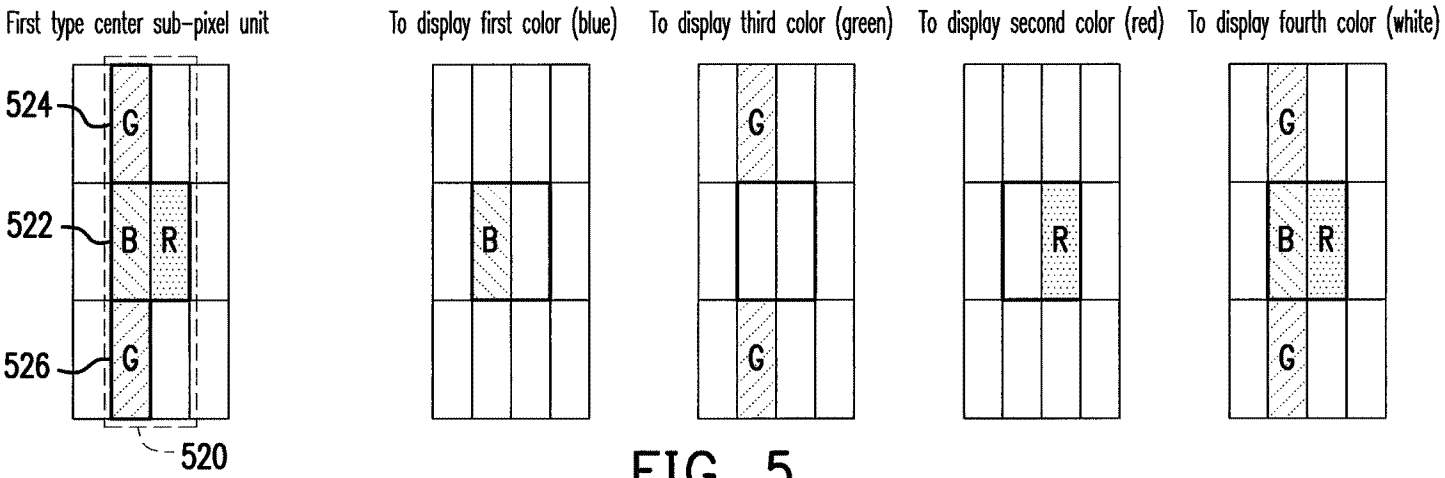
FIG. 5 is a schematic diagram of a first type center sub-pixel unit of FIG. 2 displaying different colors.

FIG. 5 is a schematic diagram of a first type center sub-pixel unit of FIG. 2 displaying different colors. Referring to FIG. 5, in the present embodiment, the first type center sub-pixel unit 522, for example, includes the first color sub-pixel B and the second color sub-pixel R. When the first type center sub-pixel unit 522 is about to display the first color (blue), the display driver 110 drives the first color sub-pixel B to display the first color, and makes the luminance thereof to be 100%. When the first type center sub-pixel unit 522 is about to display the second color (red), the display driver 110 drives the second color sub-pixel R to display the second color, and makes the luminance thereof to be 100%. Namely, in this example, the display driver 110 drives the center sub-pixel unit 522 to display the specified intensity map of the invention, and the luminance of the center sub-pixel unit 522 is greater than the luminance summation of the neighboring sub-pixel units 524 and 526.

In the present embodiment, when the first type center sub-pixel unit 522 is about to display the third color (green), the display driver 110 drives the two third color sub-pixels G vertically adjacent to the first type center sub-pixel unit 522 to operate in collaboration to display the third color, where the two third color sub-pixels G respectively display a luminance of 40%-60%, and a luminance summation thereof is 100%. Namely, in this example, the display driver 110 drives the neighboring sub-pixel units 524 and 526 to operate in collaboration with the center sub-pixel unit 522 to display the specified intensity map of the invention, and the luminance of the center sub-pixel unit 522 is smaller than a luminance summation of the neighboring sub-pixel units. When the first type center sub-pixel unit 522 is about to display a fourth color (white), the display driver 110 drives the first color sub-pixel B, the second color sub-pixel R and the two third color sub-pixels G vertically adjacent to the first color sub-pixel B to operate in collaboration to display the fourth color. The luminance summation of the first color sub-pixel B and the second color sub-pixel R is 100%. The two third color sub-pixels G, for example, respectively display a luminance of 40%-60%, and the luminance summation thereof is 100%. Namely, in this example, the display driver 110 drives the center sub-pixel unit 522 and the neighboring sub-pixel units 524 and 526 to operate in collaboration to display the specified intensity map of the invention, and the luminance of the center sub-pixel unit 522 is equal to the luminance summation of the neighboring sub-pixel units 524 and 526.

It should be noticed that in the present embodiment, although the first type center sub-pixel unit 522 including the first color sub-pixel B and the second color sub-pixel R sequentially arranged from the left to the right is taken as an example for description, the invention is not limited thereto. In an embodiment, the first type center sub-pixel unit 522 may also include the second color sub-pixel R and the first color sub-pixel B sequentially arranged from the left to the right. Moreover, in the present embodiment, when the third color or the fourth color is displayed, the display driver 110 drives the third color sub-pixels G vertically adjacent to the first color sub-pixel B to operate in collaboration, though the invention is not limited thereto. In an embodiment, according to different sub-pixel arrangement methods, the display driver 110 can also drive the third color sub-pixels G vertically adjacent to the second color sub-pixel R to operate in collaboration, which is not limited by the invention.

Figure 6:
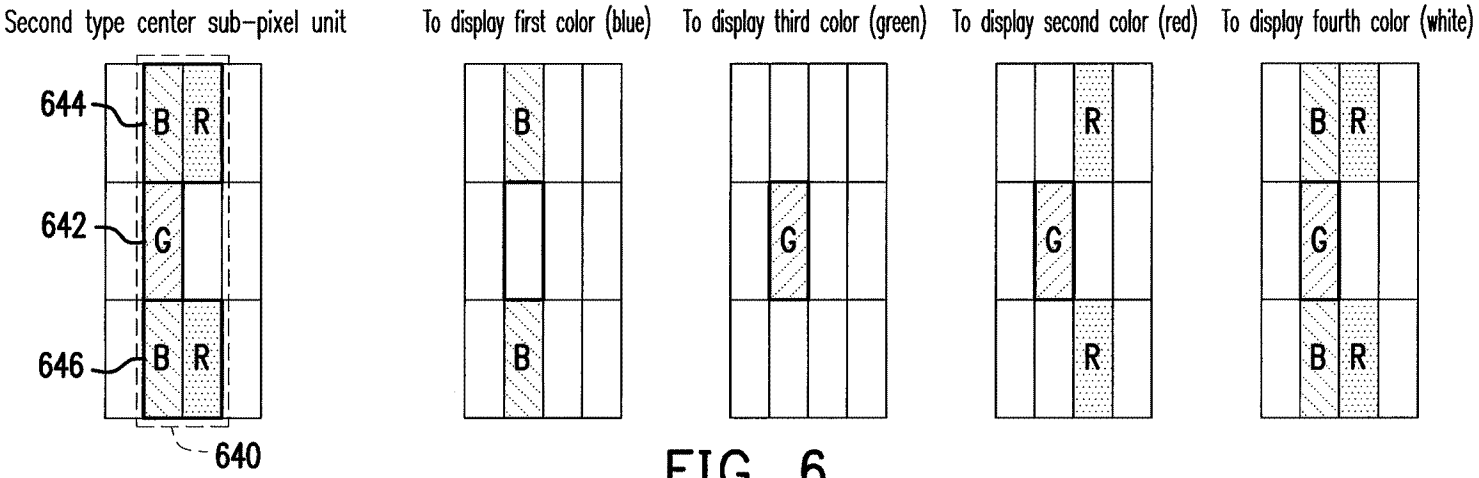
FIG. 6 is a schematic diagram of a second type center sub-pixel unit of FIG. 2 displaying different colors.

FIG. 6 is a schematic diagram of a second type center sub-pixel unit of FIG. 2 displaying different colors. Referring to FIG. 6, in the present embodiment, the second type center sub-pixel unit 642, for example, includes a single third color sub-pixel G. When the second type center sub-pixel unit 642 is about to display the third color, the display driver 110 drives the third color sub-pixel G of the center sub-pixel unit 642 to display the third color, and makes the luminance thereof to be 100%. Namely, in this example, the display driver 110 drives the center sub-pixel unit 642 to display the specified intensity map of the invention, and the luminance of the center sub-pixel unit 642 is greater than a luminance summation of the neighboring sub-pixel units.

In the present embodiment, when the second type center sub-pixel unit 642 is about to display the first color, the display driver 110 drives the two first color sub-pixels B vertically adjacent to the second type center sub-pixel unit 642 to operate in collaboration to display the first color, where the two first color sub-pixels B respectively display a luminance of 40%-60%, and a luminance summation thereof is 100%. Namely, in this example, the display driver 110 drives the neighboring sub-pixel units 644 and 646 to operate in collaboration with the center sub-pixel unit 642 to display the specified intensity map of the invention, and the luminance of the center sub-pixel unit 642 is smaller than a luminance summation of the neighboring sub-pixel units. A situation that the second type center sub-pixel unit 642 displays the second color can be deduced by analogy, and details thereof are not repeated. When the second type center sub-pixel unit 642 is about to display the fourth color, the display driver 110 drives the third color sub-pixel G and the two neighboring sub-pixel units 644 and 646 vertically adjacent to the third color sub-pixel G to operate in collaboration to display the fourth color. The luminance of the third color sub-pixel G is 100%, the two neighboring sub-pixel units 644 and 646, for example, respectively display a luminance of 40%-60%, and the luminance summation thereof is 100%. Namely, in this example, the display driver 110 drives the center sub-pixel unit 642 and the neighboring sub-pixel units 644 and 646 to operate in collaboration to display the specified intensity map of the invention, and the luminance of the center sub-pixel unit 642 is equal to the luminance summation of the neighboring sub-pixel units 644 and 646.

It should be noticed that in the present embodiment, although the neighboring sub-pixel units 644 and 646 respectively including the first color sub-pixel B and the second color sub-pixel R sequentially arranged from the left to the right is taken as an example for description, the invention is not limited thereto. In an embodiment, the neighboring sub-pixel units 644 and 646 may also respectively include the second color sub-pixel R and the first color sub-pixel B sequentially arranged from the left to the right. Moreover, in the present embodiment, when the first color is displayed, the display driver 110 drives the first color sub-pixels B vertically adjacent to the third color sub-pixel G to operate in collaboration, though the invention is not limited thereto. In an embodiment, according to different sub-pixel arrangement methods, the display driver 110 can also drive the first color sub-pixels B vertically adjacent to a pixel next to the third color sub-pixel G to operate in collaboration, which is not limited by the invention. In the present embodiment, when the second color is displayed, the display driver 110 drives the second color sub-pixels R vertically adjacent to the pixel next to the third color sub-pixel G to operate in collaboration, though the invention is not limited thereto. In an embodiment, according to different sub-pixel arrangement methods, the display driver 110 can also drive the second color sub-pixels R vertically adjacent to the third color sub-pixel G to operate in collaboration, which is not limited by the invention.

In the present invention, the display driver 110, for example, drives the map display unit according to an edge relationship of the map display unit, so as to make at least one of the center sub-pixel unit and the neighboring sub-pixel units to display the specified intensity map. For example, taking the map display unit 420 of FIG. 4 as an example, the display driver 110, for example, determines an edge relationship of the map display unit 420 according to the pixel data written into the center sub-pixel unit B2, R2, the neighboring pixel unit G21 (the first sub-pixel unit) and the neighboring pixel unit G22 (the second sub-pixel unit) and an edge threshold. Then, the display driver 110 drives the map display unit 410 according to the edge relationship obtained through the determination. At least one embodiment is provided below to describe the method that the display driver 110 determines the edge relationship, though the invention is not limited to the provided embodiments, and the embodiments can be suitably combined.

FIG. 7A to FIG. 7D are schematic diagrams of the display driver driving the first type center sub-pixel unit according to the edge relationship according to an embodiment of the invention. Referring to FIG. 7A to FIG. 7D, the center sub-pixel unit 722 of the present embodiment is, for example, the first type center sub-pixel unit, and includes the first color sub-pixel B and the second color sub-pixel R. The neighboring sub-pixel units include a first neighboring sub-pixel unit 724 and a second neighboring sub-pixel unit 726. The first neighboring sub-pixel unit 724 and the second neighboring sub-pixel unit 726 respectively includes a single third color sub-pixel G. In the present embodiment, the display driver 110 determines an edge relationship of the map display unit 720 according to the pixel data written into the center sub-pixel unit 722, the first neighboring sub-pixel unit 724 and the second neighboring sub-pixel unit 726 and an edge threshold. In the present embodiment, the pixel data and the predetermined edge threshold used by the display driver 110 for determination are, for example, display data related to pixel luminance, and the edge threshold is, for example, a predetermined display parameter related to the pixel luminance.

Figure 7A:
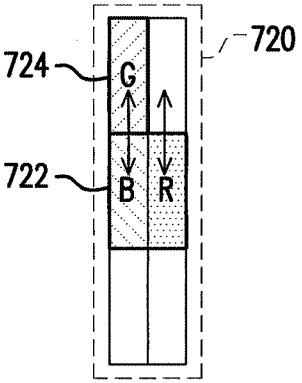
FIG. 7A to FIG. 7D are schematic diagrams of a display driver driving a first type center sub-pixel unit according to an edge relationship according to an embodiment of the invention.

Referring to FIG. 7A, in the present embodiment, after determination, if a data difference between the center sub-pixel unit 722 and the first neighboring sub-pixel unit 724 is greater than the edge threshold, the display driver 110 drives the center sub-pixel unit 722 and the first neighboring sub-pixel unit 724 to operate in collaboration to display the specified intensity map, so as to achieve a sub-pixel color diffusion effect. In the present embodiment, the situation that the data difference between the center sub-pixel unit 722 and the first neighboring sub-pixel unit 724 is greater than the edge threshold may include two implementations, and one implementation is that the pixel data of the center sub-pixel unit 722 is greater than the pixel data of the first neighboring sub-pixel unit 724, and another implementation is that the pixel data of the center sub-pixel unit 722 is smaller than the pixel data of the first neighboring sub-pixel unit 724. In this example, if the data difference between the center sub-pixel unit 722 and the first neighboring sub-pixel unit 724 is greater than the edge threshold, and the pixel data of the center sub-pixel unit 722 is greater than the pixel data of the first neighboring sub-pixel unit 724, such edge relationship is encoded as digital data "2", which represents that according to the pixel data to be written, it is determined that the luminance of the center sub-pixel unit 722 is greater than the luminance of the first neighboring sub-pixel unit 724 and a difference thereof exceeds the edge threshold. If the data difference between the center sub-pixel unit 722 and the first neighboring sub-pixel unit 724 is greater than the edge threshold, and the pixel data of the center sub-pixel unit 722 is smaller than the pixel data of the first neighboring sub-pixel unit 724, such edge relationship is encoded as digital data "8", which represents that according to the pixel data to be written, it is determined that the luminance of the center sub-pixel unit 722 is smaller than the luminance of the first neighboring sub-pixel unit 724 and a difference thereof exceeds the edge threshold. Therefore, in the present embodiment, the display driver 110 drives the center sub-pixel unit 722 and the first neighboring sub-pixel unit 724 to operate in collaboration to display the specified intensity map according to the edge relationship encoded as the digital data "2" or "8", so as to achieve the sub-pixel color diffusion effect.

Figure 7B:
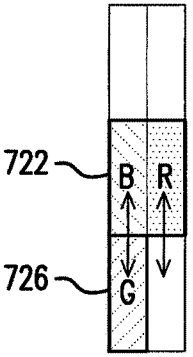

Referring to FIG. 7B, in the present embodiment, after determination, if a data difference between the center sub-pixel unit 722 and the second neighboring sub-pixel unit 726 is greater than the edge threshold, the display driver 110 drives the center sub-pixel unit 722 and the second neighboring sub-pixel unit 726 to operate in collaboration to display the specified intensity map, so as to achieve a sub-pixel color diffusion effect. In the present embodiment, the situation that the data difference between the center sub-pixel unit 722 and the second neighboring sub-pixel unit 726 is greater than the edge threshold may include two implementations, and one implementation is that the pixel data of the center sub-pixel unit 722 is greater than the pixel data of the second neighboring sub-pixel unit 726, and another implementation is that the pixel data of the center sub-pixel unit 722 is smaller than the pixel data of the second neighboring sub-pixel unit 726. In this example, if the data difference between the center sub-pixel unit 722 and the second neighboring sub-pixel unit 726 is greater than the edge threshold, and the pixel data of the center sub-pixel unit 722 is greater than the pixel data of the second neighboring sub-pixel unit 726, such edge relationship is encoded as digital data "1", which represents that according to the pixel data to be written, it is determined that the luminance of the center sub-pixel unit 722 is greater than the luminance of the second neighboring sub-pixel unit 726 and a difference thereof exceeds the edge threshold. If the data difference between the center sub-pixel unit 722 and the second neighboring sub-pixel unit 726 is greater than the edge threshold, and the pixel data of the center sub-pixel unit 722 is smaller than the pixel data of the second neighboring sub-pixel unit 726, such edge relationship is encoded as digital data "4", which represents that according to the pixel data to be written, it is determined that the luminance of the center sub-pixel unit 722 is smaller than the luminance of the second neighboring sub-pixel unit 726 and a difference thereof exceeds the edge threshold. Therefore, in the present embodiment, the display driver 110 drives the center sub-pixel unit 722 and the second neighboring sub-pixel unit 726 to operate in collaboration to display the specified intensity map according to the edge relationship encoded as the digital data "2" or "8", so as to achieve the sub-pixel color diffusion effect.

Figure 7C:
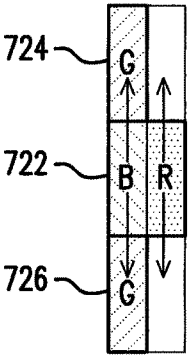

Referring to FIG. 7C, in the present embodiment, after determination, if a data difference between the center sub-pixel unit 722 and the first neighboring sub-pixel unit 724 and a data difference between the center sub-pixel unit 722 and the second neighboring sub-pixel unit 726 are all greater than the edge threshold, and the pixel data of the center sub-pixel unit 722 is greater than the pixel data of the first neighboring sub-pixel unit 724 and the pixel data of the second neighboring sub-pixel unit 726, the display driver 110 drives the center sub-pixel unit 722, the first neighboring sub-pixel unit 724 and the second neighboring sub-pixel unit 726 to operate in collaboration to display the specified intensity map, so as to achieve a sub-pixel color diffusion effect. In the present embodiment, such edge relationship is encoded as digital data "3", which represents that according to the pixel data to be written, it is determined that the luminance of the center sub-pixel unit 722 is the greatest among the luminance of the three sub-pixel units, and a difference thereof exceeds the edge threshold. Therefore, in the present embodiment, the display driver 110 drives the center sub-pixel unit 722, the first neighboring sub-pixel unit 724 and the second neighboring sub-pixel unit 726 to operate in collaboration to display the specified intensity map according to the edge relationship encoded as the digital data "3", so as to achieve the sub-pixel color diffusion effect.

Figure 7D:
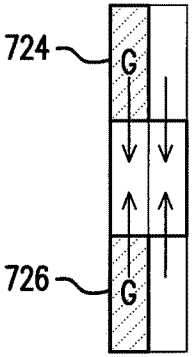
Figure 8A:
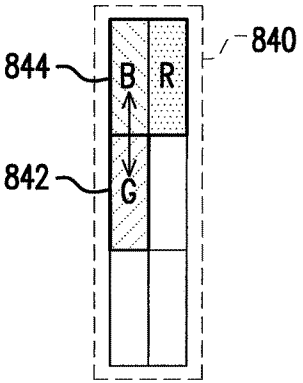
FIG. 8A to FIG. 8D are schematic diagrams of a display driver driving a second type center sub-pixel unit according to an edge relationship according to an embodiment of the invention.
Figure 8B:
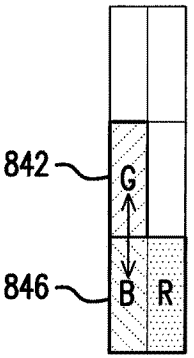
Figure 8C:
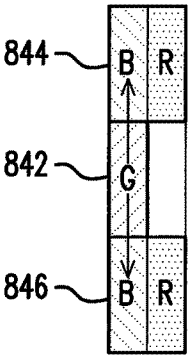
Figure 8D:
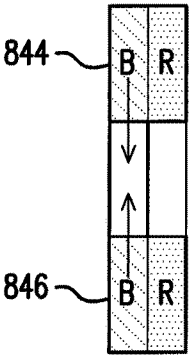

Referring to FIG. 7D, in the present embodiment, after determination, if a data difference between the center sub-pixel unit 722 and the first neighboring sub-pixel unit 724 and a data difference between the center sub-pixel unit 722 and the second neighboring sub-pixel unit 726 are all greater than the edge threshold, and the pixel data of the center sub-pixel unit 722 is smaller than the pixel data of the first neighboring sub-pixel unit 724 and the pixel data of the second neighboring sub-pixel unit 726, the display driver 110 drives the first neighboring sub-pixel unit 724 and the second neighboring sub-pixel unit 726 to operate in collaboration to display the specified intensity map, so as to achieve a sub-pixel color diffusion effect. In the present embodiment, such edge relationship is encoded as digital data "12", which represents that according to the pixel data to be written, it is determined that the luminance of the center sub-pixel unit 722 is the smallest among the luminance of the three sub-pixel units, and a difference thereof exceeds the edge threshold. Therefore, in the present embodiment, the display driver 110 drives the first neighboring sub-pixel unit 724 and the second neighboring sub-pixel unit 726 to operate in collaboration to display the specified intensity map according to the edge relationship encoded as the digital data "12", so as to achieve the sub-pixel color diffusion effect.

FIG. 8A to FIG. 8D are schematic diagrams of the display driver driving the second type center sub-pixel unit according to the edge relationship according to an embodiment of the invention. Referring to FIG. 8A to FIG. 8D, the method that the display driver 110 drives a map display unit 840 according to the edge relationship is similar to that of the embodiment of FIG. 7A to FIG. 7D, and a main difference there between is that a center sub-pixel unit 842 is the second type center sub-pixel unit, which includes the single third color sub-pixel G. The first neighboring sub-pixel unit 844 and the second neighboring sub-pixel unit 846 respectively include a combination of the first color sub-pixel B and a second color sub-pixel R. In the present embodiment, the display driver 110 determines an edge relationship of the map display unit 840 according to the pixel data written into the center sub-pixel unit 842, the first neighboring sub-pixel unit 844 and the second neighboring sub-pixel unit 846 and the edge threshold. Moreover, since the method that the display driver 110 drives the map display unit 840 according to the edge relationship can be deduced according to the embodiment of FIG. 7A to FIG. 7D, detailed description thereof is not repeated.

Figure 9:
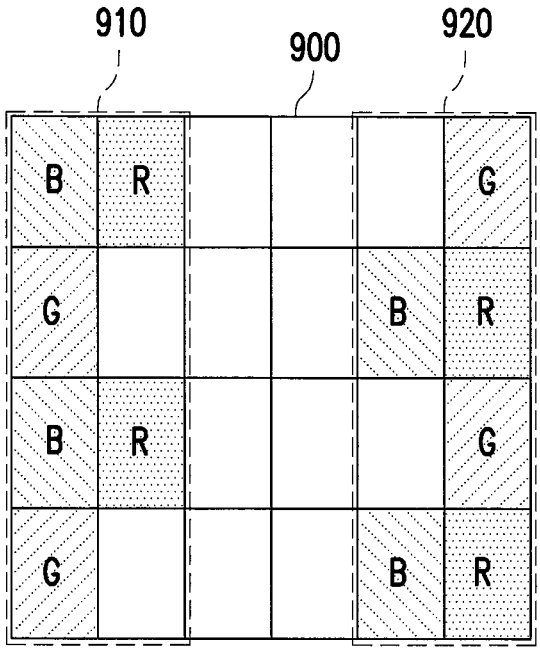
FIG. 9 is a schematic diagram of a pixel array displaying a plurality of specified intensity maps in overall according to an embodiment of the invention.

FIG. 9 is a schematic diagram of a pixel array displaying a plurality of specified intensity maps in overall according to an embodiment of the invention. Referring to FIG. 9, in the present embodiment, the display driver 110 applies the display driving method of the invention to drive the pixel array 900 to display a plurality of specified intensity maps of an image. In this example, on vertical lines 910 and 920 of the pixel array 900, the first color sub-pixel B, the second color sub-pixel R and the third color sub-pixel G of each vertical line operate in collaboration to display a luminance with a summation thereof reaching 100%.

Figure 10:
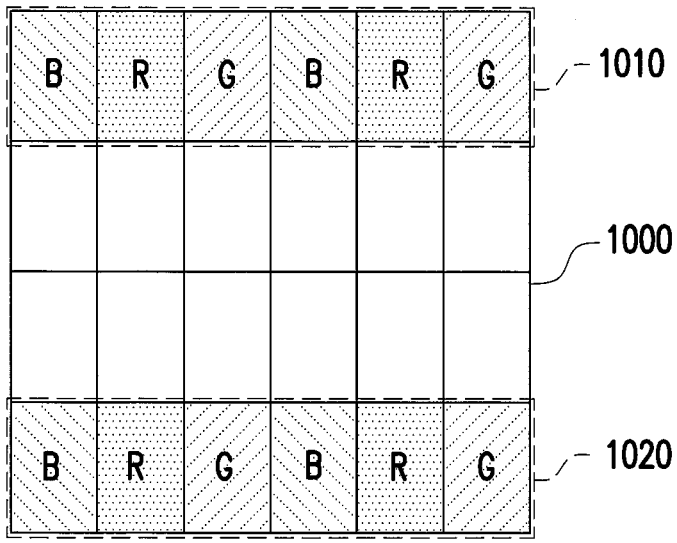
FIG. 10 is a schematic diagram of a pixel array displaying a plurality of specified intensity maps in overall according to another embodiment of the invention.

FIG. 10 is a schematic diagram of a pixel array displaying a plurality of specified intensity maps in overall according to another embodiment of the invention. Referring to FIG. 10, in the present embodiment, the display driver 110 applies the display driving method of the invention to drive the pixel array 1000 to display a plurality of specified intensity maps of an image. In this example, on horizontal lines 1010 and 1020 of the pixel array 1000, the first color sub-pixel B, the second color sub-pixel R and the third color sub-pixel G of each horizontal line operate in collaboration to display a luminance with a summation thereof reaching 100%.

Figure 11:
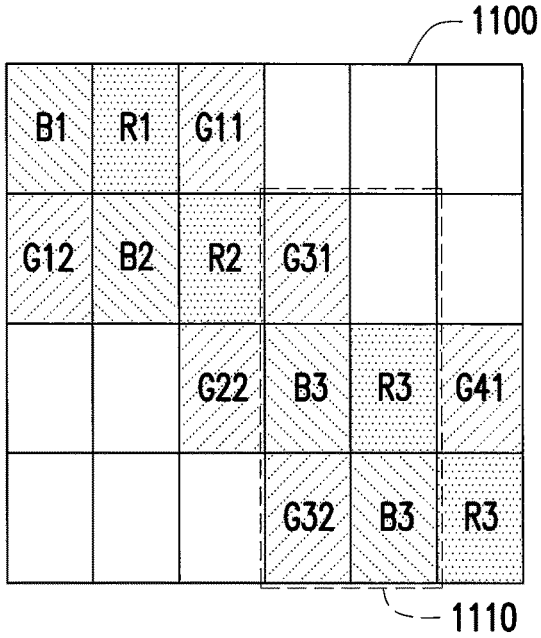
FIG. 11 is a schematic diagram of a pixel array displaying a plurality of specified intensity maps in overall according to another embodiment of the invention.

FIG. 11 is a schematic diagram of a pixel array displaying a plurality of specified intensity maps in overall according to another embodiment of the invention. Referring to FIG. 11, in the present embodiment, the display driver 110 applies the display driving method of the invention to drive the pixel array 1100 to display a plurality of specified intensity maps of an image. In this example, on an oblique line of the pixel array 1100, the third color to be displayed by a map display unit 1110 has been diffused, and the third color sub-pixels G31 and G32 operate in collaboration to display the third color.

Figure 12:
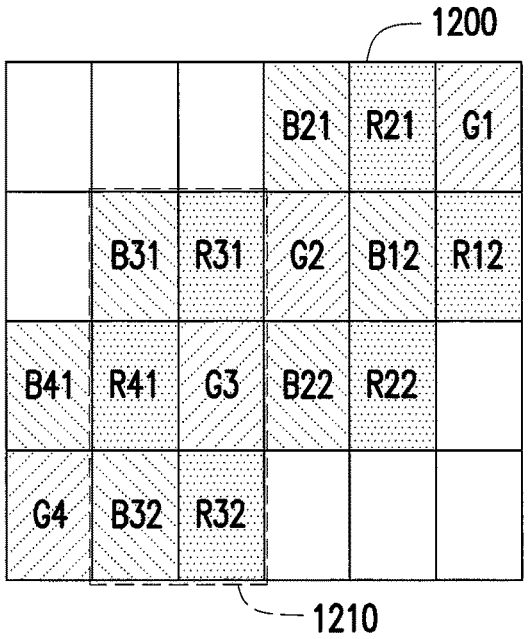
FIG. 12 is a schematic diagram of a pixel array displaying a plurality of specified intensity maps in overall according to another embodiment of the invention.

FIG. 12 is a schematic diagram of a pixel array displaying a plurality of specified intensity maps in overall according to another embodiment of the invention. Referring to FIG. 12, in the present embodiment, the display driver 110 applies the display driving method of the invention to drive the pixel array 1200 to display a plurality of specified intensity maps of an image. In this example, on an oblique line of the pixel array 1200, the first color and the second color to be displayed by a map display unit 1210 have been diffused, and the first color sub-pixels B31 and B32 operate in collaboration to display the first color, and the second color sub-pixels R31 and R32 operate in collaboration to display the second color.

In the invention, the overall specified intensity maps of the pixel arrays shown in FIG. 9 to FIG. 12 are only examples, and the invention is not limited thereto. In the plurality of specified intensity maps shown in FIG. 9 to FIG. 12, when the observer observes the specified intensity maps, a visual center thereof approximately focuses on the center of each of the specified intensity maps. In an embodiment, according to the display driving method disclosed by FIG. 2 to FIG. 8D, the overall specified intensity map of the 2X data mapping pixel array may have other implementations, which are not limited by the invention.

Therefore, in the embodiments of FIG. 2 to FIG. 12, the display driver 110 writes the pixel data into the pixel array in the data mapping method of a first rate (2X), and when the pixel array is driven, the color displayed by each sub-pixel is diffused in the vertical direction, so as to provide good display quality while at least considering the display luminance.

Figure 13:
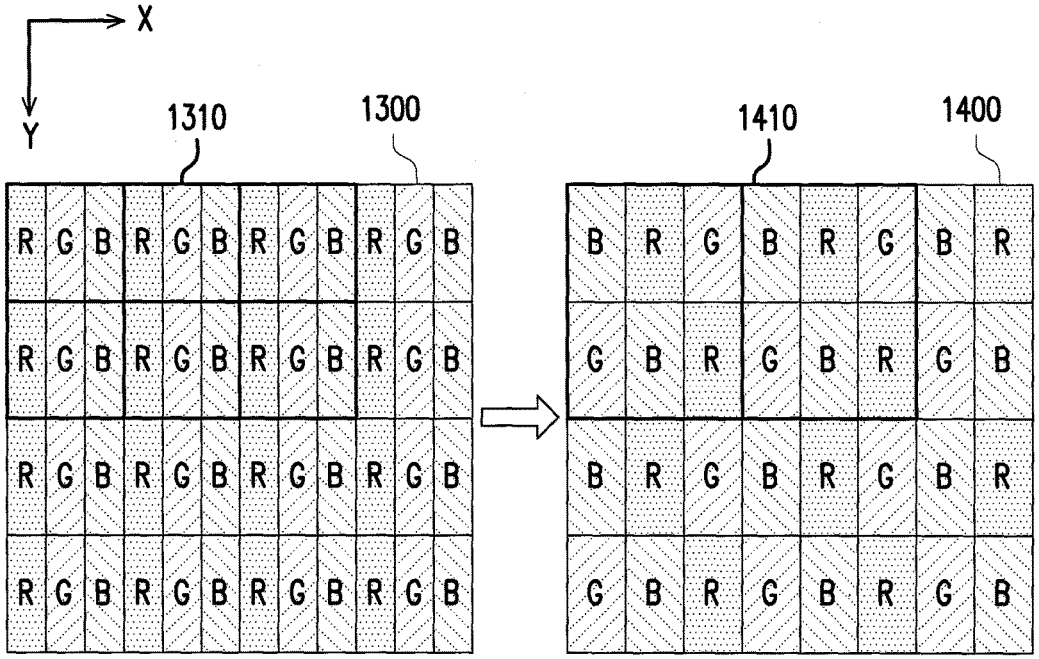
FIG. 13 is a schematic diagram of a pixel array and pixel data written into the pixel array according to another embodiment of the invention.
Figure 14:
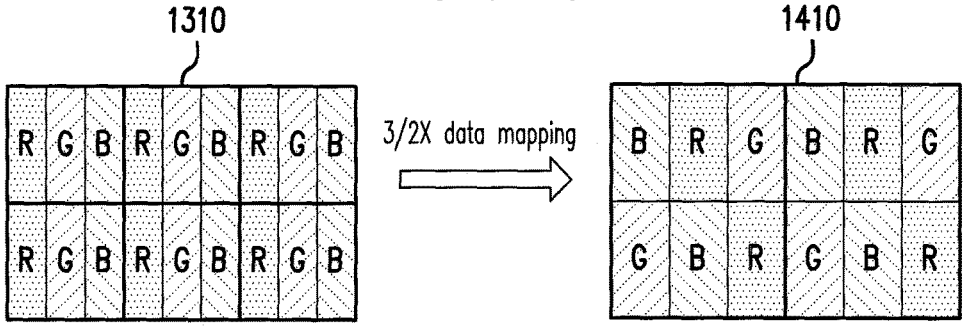
FIG. 14 is a schematic diagram of a sub-pixel repeat array of FIG. 13 and pixel data written into the sub-pixel repeat array.

FIG. 13 is a schematic diagram of a pixel array and pixel data written into the pixel array according to another embodiment of the invention. FIG. 14 is a schematic diagram of a sub-pixel repeat array of FIG. 13 and pixel data written into the sub-pixel repeat array. Referring to FIG. 1, FIG. 13 and FIG. 14, in the present embodiment, the display driver 110, for example, writes the pixel data 1300 into the pixel array 1400 to drive the display panel 120 to display an image. The pixel array 1400 of the present embodiment is, for example, a part of or all of the pixel array arranged on the display panel 120, and a sub-pixel repeat array of the pixel array 1400 is repeatedly arranged to form the pixel array 1400. The sub-pixel repeat array of the present embodiment is the same to the sub-pixel repeat unit 310 of FIG. 3. It should be noticed that the sub-pixel array 1410 of FIG. 14 includes two sub-pixel repeat arrays. In the present embodiment, the display driver 110, for example, writes pixel data 1310 with a dimension of 3×2 into the sub-pixel array 1410 in a 3/2X data mapping method.

Figure 15:
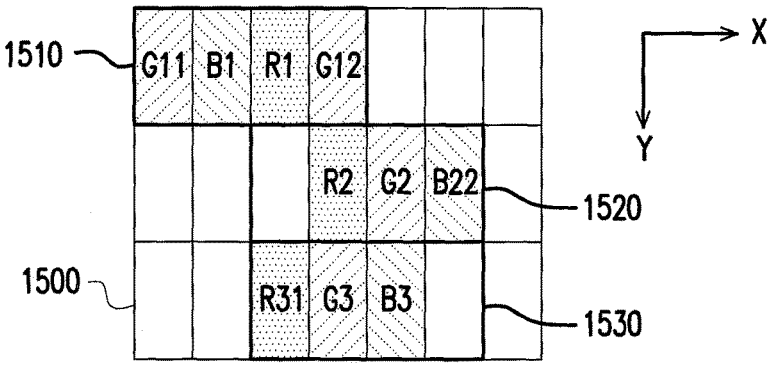
FIG. 15 is a schematic diagram of a pixel array according to another embodiment of the invention.

FIG. 15 is a schematic diagram of a pixel array according to another embodiment of the invention. Referring to FIG. 1, FIG. 13 and FIG. 15, the pixel array 1500 of the present embodiment is, for example, formed by repeatedly arranging the sub-pixel repeat unit 310 of FIG. 3, which is, for example, a part of or all of the pixel array arranged on the display panel 120 of FIG. 1. In the present embodiment, the display driver 110, for example, writes pixel data into the sub-pixel array 1500 in a 3/2X data mapping method. The pixel array 1500 includes a plurality of map display units 1510-1530, which are used for displaying at least one specified intensity map of the image.

To be specific, taking the map display unit 1510 as an example, the map display unit 1510 includes a center sub-pixel unit B1, R1 and a plurality of neighboring sub-pixel units G11, G12. The center sub-pixel unit B1, R1 and the neighboring sub-pixel units G11, G12 are arranged adjacent to each other along the horizontal direction X while taking the center sub-pixel unit B1, R1 as a center. In this example, the center sub-pixel unit B1, R1 includes the first color sub-pixel B1 and the second color sub-pixel R1, and the neighboring sub-pixel units G11, G12 respectively includes a single third color sub-pixel G11 or G12. In the present embodiment, the display driver 110 drives the map display unit 1510 to make the center sub-pixel unit B1, R1 and the neighboring sub-pixel units G11, G12 to display the specified intensity map of the image. For example, in an embodiment, the specified intensity map of the map display unit 1510 is, for example, to have a luminance of 2 unit intensities (6/3), and when the luminance displayed by the center sub-pixel unit B1, R1 occupies a share of 4/3, the luminance displayed by each of the neighboring sub-pixel units G11, G12 respectively occupies a share of 1/3.

Taking the map display unit 1520 as an example, in the present embodiment, the display driver 110 drives the map display unit 1520 to make the center sub-pixel unit R2, G2 and the neighboring sub-pixel unit B22 located to the right side to display the specified intensity map of the image. For example, in an embodiment, the specified intensity map of the map display unit 1520 is, for example, to have a luminance of 2 unit intensities, and when the luminance displayed by the center sub-pixel unit R2, G2 occupies a share of 4/3, the luminance displayed by the neighboring sub-pixel unit B22 occupies a share of 2/3. Moreover, the sub-pixel arrangement of the map display unit 1530 of the present embodiment and the operation method thereof can be deduced by analogy.

In the present embodiment, according to the sub-pixel arrangement of each of the map display units and the operation method thereof, when the observer observes the specified intensity maps, a visual center thereof approximately focuses on the center of each of the specified intensity maps. Moreover, in each of the specified intensity maps, the luminance of the center sub-pixel unit is substantially equal to a luminance summation of the neighboring sub-pixel units.

Figure 16:
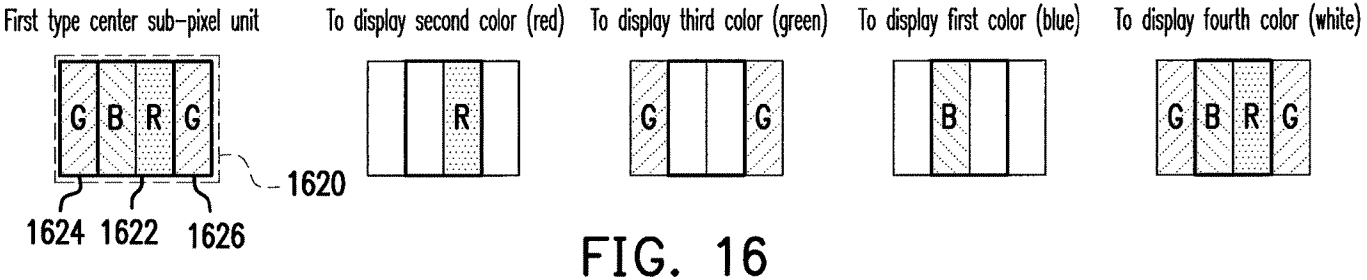
FIG. 16 is a schematic diagram of a first type center sub-pixel unit of FIG. 13 displaying different colors.

FIG. 16 is a schematic diagram of a first type center sub-pixel unit of FIG. 13 displaying different colors. Referring to FIG. 16, in the present embodiment, the first type center sub-pixel unit 1622, for example, includes the first color sub-pixel B and the second color sub-pixel R. When the first type center sub-pixel unit 1622 is about to display the first color (blue), the display driver 110 drives the first color sub-pixel B to display the first color, and makes the luminance thereof to occupy a share of 2/3 in the 2 unit intensities. When the first type center sub-pixel unit 1622 is about to display the second color (red), the display driver 110 drives the second color sub-pixel R to display the second color, and makes the luminance thereof to occupy a share of 2/3 in the 2 unit intensities. Namely, in this example, the display driver 110 drives the center sub-pixel unit 1622 to display the specified intensity map of the invention, and the luminance of the center sub-pixel unit 1622 is greater than the luminance summation of the neighboring sub-pixel units 1624 and 1626.

In the present embodiment, when the first type center sub-pixel unit 1622 is about to display the third color (green), the display driver 110 drives the two third color sub-pixels G horizontally adjacent to the first type center sub-pixel unit 1622 to operate in collaboration to display the third color, where the luminance of the two third color sub-pixels G respectively occupies a share of 1/3 in the 2 unit intensities. Namely, in this example, the display driver 110 drives the neighboring sub-pixel units 1624 and 1626 to operate in collaboration with the center sub-pixel unit 1622 to display the specified intensity map of the invention, and the luminance of the center sub-pixel unit 1622 is smaller than a luminance summation of the neighboring sub-pixel units. When the first type center sub-pixel unit 1622 is about to display the fourth color (white), the display driver 110 drives the first color sub-pixel B, the second color sub-pixel R and the two third color sub-pixels G horizontally adjacent thereto to operate in collaboration to display the fourth color. The luminance summation of the first color sub-pixel B and the second color sub-pixel R occupies a share of 4/3 in the 2 unit intensities. The luminance of the two third color sub-pixels G, for example, respectively occupies a share of 1/3 in the 2 unit intensities. Namely, in this example, the display driver 110 drives the center sub-pixel unit 1622 and the neighboring sub-pixel units 1624 and 1626 to operate in collaboration to display the specified intensity map of the invention, and the luminance of the center sub-pixel unit 1622 is equal to the luminance summation of the neighboring sub-pixel units 1624 and 1626.

It should be noticed that in the present embodiment, although the first type center sub-pixel unit 1622 including the first color sub-pixel B and the second color sub-pixel R sequentially arranged from the left to the right is taken as an example for description, the invention is not limited thereto. In an embodiment, the first type center sub-pixel unit 1622 may also include the second color sub-pixel R and the first color sub-pixel B sequentially arranged from the left to the right.

Figure 17:
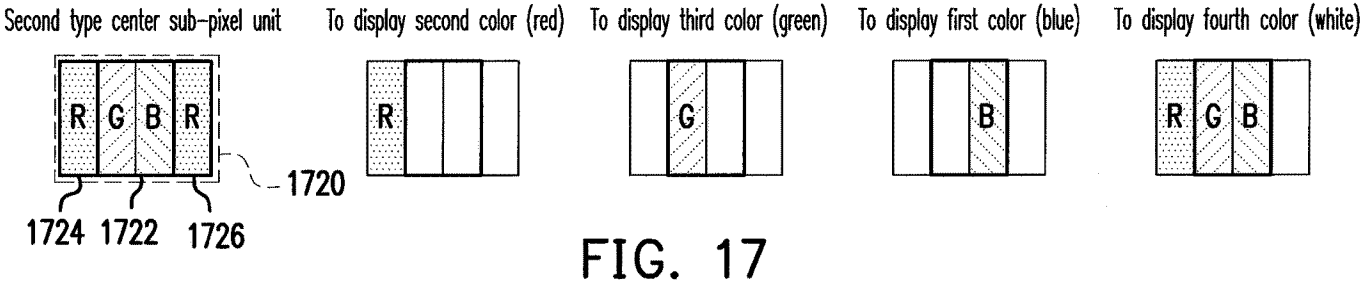
FIG. 17 is a schematic diagram of a second type center sub-pixel unit of FIG. 13 displaying different colors.

FIG. 17 is a schematic diagram of a second type center sub-pixel unit of FIG. 13 displaying different colors. Referring to FIG. 17, in the present embodiment, the second type center sub-pixel unit 1722, for example, includes the third color sub-pixel G and the first color sub-pixel B. When the second type center sub-pixel unit 1722 is about to display the first color (blue), the display driver 110 drives the first color sub-pixel B to display the first color, and makes the luminance thereof to occupy a share of 2/3 in the 2 unit intensities. When the second type center sub-pixel unit 1722 is about to display the third color (green), the display driver 110 drives the third color sub-pixel G to display the third color, and makes the luminance thereof to occupy a share of 2/3 in the 2 unit intensities. Namely, in this example, the display driver 110 drives the center sub-pixel unit 1722 to display the specified intensity map of the invention, and the luminance of the center sub-pixel unit 1722 is greater than the luminance summation of the neighboring sub-pixel units 1724 and 1726.

In the present embodiment, when the second type center sub-pixel unit 1722 is about to display the second color (red), the display driver 110 drives the second color sub-pixels R horizontally adjacent to the left of the second type center sub-pixel unit 1722 to operate in collaboration to display the second color, and the luminance of the second color sub-pixel R occupies a share of 2/3 in the 2 unit intensities. Namely, in this example, the display driver 110 drives the neighboring sub-pixel unit 1724 to operate in collaboration with the center sub-pixel unit 1722 to display the specified intensity map of the invention, and the luminance of the center sub-pixel unit 1722 is smaller than a luminance summation of the neighboring sub-pixel units. When the second type center sub-pixel unit 1722 is about to display the fourth color (white), the display driver 110 drives the third color sub-pixel G, the first color sub-pixel B and the second color sub-pixel R horizontally adjacent to the left of the third color sub-pixel G to operate in collaboration to display the fourth color. The luminance summation of the third color sub-pixel G and the first color sub-pixel B occupies a share of 4/3 in the 2 unit intensities. The luminance of the second color sub-pixels R, for example, occupies a share of 2/3 in the 2 unit intensities. In the present embodiment, the luminance of the third color sub-pixel G and the first color sub-pixel B, for example, respectively occupies a share of 2/3 in the 2 unit intensities, such that when the observer observes the specified intensity maps, the visual center thereof approximately focuses on the center of each of the specified intensity maps. Namely, in this example, the display driver 110 drives the center sub-pixel unit 1722 and the neighboring sub-pixel unit 1724 to operate in collaboration to display the specified intensity map of the invention, and the luminance of the center sub-pixel unit 1722 is greater than the luminance of the neighboring sub-pixel unit 1724.

It should be noticed that in the present embodiment, although the second type center sub-pixel unit 1722 including the third color sub-pixel G and the first color sub-pixel B sequentially arranged from the left to the right is taken as an example for description, the invention is not limited thereto. In an embodiment, the second type center sub-pixel unit 1722 may also include the first color sub-pixel B and the third color sub-pixel G sequentially arranged from the left to the right.

Figure 18:
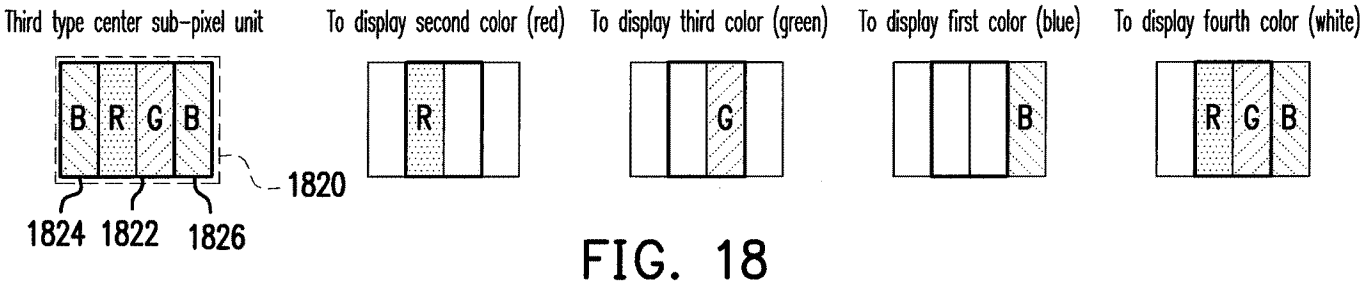
FIG. 18 is a schematic diagram of a third type center sub-pixel unit of FIG. 13 displaying different colors.

FIG. 18 is a schematic diagram of a third type center sub-pixel unit of FIG. 13 displaying different colors. Referring to FIG. 18, the third type center sub-pixel unit 1822 of the present embodiment is similar to the second type center sub-pixel unit 1722 of FIG. 17, and a main difference there between lies in different colors and arrangements of the sub-pixels included in each of the center sub-pixel units. In the present embodiment, the third type center sub-pixel unit 1822, for example, includes the second color sub-pixel R and the third color sub-pixel G arranged from the left to the right. Moreover, the method that the display driver 110 of the present embodiment drives the center sub-pixel unit 1822 to display different colors and the operations thereof are similar to that of the embodiment of FIG. 17, and details thereof are not repeated. When the third type center sub-pixel unit 1822 is about to display the fourth color, the display driver 110 drives the second color sub-pixel R, the third color sub-pixel G and the first color sub-pixel B horizontally adjacent to the right of the third color sub-pixel G to operate in collaboration to display the fourth color, such that when the observer observes the specified intensity maps, the visual center thereof focuses on the center of each of the specified intensity maps.

It should be noticed that in the present embodiment, although the third type center sub-pixel unit 1822 including the second color sub-pixel R and the third color sub-pixel G sequentially arranged from the left to the right is taken as an example for description, the invention is not limited thereto. In an embodiment, the third type center sub-pixel unit 1822 may also include the third color sub-pixel G and the second color sub-pixel R sequentially arranged from the left to the right.

In the present invention, the display driver 110, for example, drives the map display unit according to an edge relationship of the map display unit, so as to make at least one of the center sub-pixel unit and the neighboring sub-pixel units to display the specified intensity map. For example, taking the map display unit 1510 of FIG. 15 as an example, the display driver 110, for example, determines an edge relationship of the map display unit 1510 according to the pixel data written into the center sub-pixel unit B1, R1, the neighboring pixel unit G11 (the first sub-pixel unit) and the neighboring pixel unit G12 (the second sub-pixel unit) and an edge threshold. Then, the display driver 110 drives the map display unit 1510 according to the edge relationship obtained through the determination. At least one embodiment is provided below to describe the method that the display driver 110 determines the edge relationship, though the invention is not limited to the provided embodiments, and the embodiments can be suitably combined.

Figure 19A:
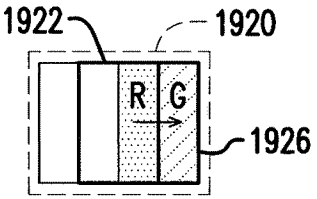
FIG. 19A to FIG. 19C are schematic diagrams of a display driver driving a first type center sub-pixel unit according to an edge relationship according to another embodiment of the invention.
Figure 19B:
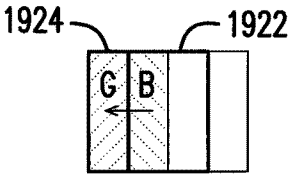
Figure 19C:
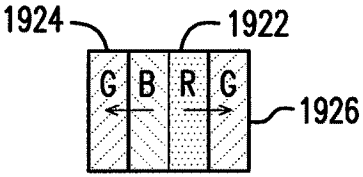

FIG. 19A to FIG. 19C are schematic diagrams of the display driver driving the first type center sub-pixel unit according to the edge relationship according to another embodiment of the invention. Referring to FIG. 19A to FIG. 19C, the center sub-pixel unit 1922 of the present embodiment is, for example, the first type center sub-pixel unit, and includes the first color sub-pixel B and the second color sub-pixel R. The neighboring sub-pixel units include a first sub-pixel unit 1924 and a second sub-pixel unit 1926. The first sub-pixel unit 1924 and the second sub-pixel unit 1926 respectively includes a single third color sub-pixel G. In the present embodiment, the display driver 110 determines an edge relationship of the map display unit 1920 according to the pixel data written into the center sub-pixel unit 1922, the first sub-pixel unit 1924 and the second sub-pixel unit 1926 and an edge threshold. In the present embodiment, the pixel data and the predetermined edge threshold used by the display driver 110 for determination are, for example, display data related to pixel luminance, and the edge threshold is, for example, a predetermined display parameter related to the pixel luminance.

Referring to FIG. 19A, in the present embodiment, after determination, if a data difference between the center sub-pixel unit 1922 and the second sub-pixel unit 1926 is greater than the edge threshold, the display driver 110 drives the center sub-pixel unit 1922 and the second sub-pixel unit 1926 to operate in collaboration to display the specified intensity map, so as to achieve the sub-pixel color diffusion effect. In the present embodiment, the situation that the data difference between the center sub-pixel unit 1922 and the second sub-pixel unit 1926 is greater than the edge threshold may include two implementations, and one implementation is that the pixel data of the center sub-pixel unit 1922 is greater than the pixel data of the second sub-pixel unit 1926, and another implementation is that the pixel data of the center sub-pixel unit 1922 is smaller than the pixel data of the second sub-pixel unit 1926.

In this example, if the data difference between the center sub-pixel unit 1922 and the second sub-pixel unit 1926 is greater than the edge threshold, and the pixel data of the center sub-pixel unit 1922 is greater than the pixel data of the second sub-pixel unit 1926, such edge relationship is encoded as digital data "1", which represents that according to the pixel data to be written, it is determined that the luminance of the center sub-pixel unit 1922 is greater than the luminance of the second sub-pixel unit 1926 and a difference thereof exceeds the edge threshold. In the present embodiment, according to such driving method, the color displayed by the second color sub-pixel R of the center sub-pixel unit 1922 is diffused to the color of the neighboring third color sub-pixel G. Therefore, in view of the whole specified intensity map of the map display unit 1920, the luminance of the second color of the center sub-pixel unit 1922 occupies a share of 2/3, and the luminance of the second color of the second sub-pixel unit 1926 occupies a share of 1/3.

If the data difference between the center sub-pixel unit 1922 and the second sub-pixel unit 1926 is greater than the edge threshold, and the pixel data of the center sub-pixel unit 1922 is smaller than the pixel data of the second sub-pixel unit 1926, such edge relationship is encoded as digital data "4", which represents that according to the pixel data to be written, it is determined that the luminance of the center sub-pixel unit 1922 is smaller than the luminance of the second sub-pixel unit 1926 and a difference thereof exceeds the edge threshold. In the present embodiment, according to such driving method, the color displayed by the second color sub-pixel R of the center sub-pixel unit 1922 is diffused to the color of the neighboring third color sub-pixel G. Therefore, in view of the whole specified intensity map of the map display unit 1920, the luminance of the second color of the center sub-pixel unit 1922 occupies a share of 1/3, and the luminance of the second color of the second sub-pixel unit 1926 occupies a share of 2/3.

Therefore, in the present embodiment, the display driver 110 drives the center sub-pixel unit 1922 and the second sub-pixel unit 1926 to operate in collaboration to display the specified intensity map according to the edge relationship encoded as the digital data "1" or "4", so as to achieve the sub-pixel color diffusion effect.

Referring to FIG. 19B, in the present embodiment, after determination, if a data difference between the center sub-pixel unit 1922 and the first sub-pixel unit 1924 is greater than the edge threshold, the display driver 110 drives the center sub-pixel unit 1922 and the first sub-pixel unit 1924 to operate in collaboration to display the specified intensity map, so as to achieve a sub-pixel color diffusion effect. In the present embodiment, the situation that the data difference between the center sub-pixel unit 1922 and the first sub-pixel unit 1924 is greater than the edge threshold may include two implementations, and one implementation is that the pixel data of the center sub-pixel unit 1922 is greater than the pixel data of the first sub-pixel unit 1924, and another implementation is that the pixel data of the center sub-pixel unit 1922 is smaller than the pixel data of the first sub-pixel unit 1924.

In this example, if the data difference between the center sub-pixel unit 1922 and the first sub-pixel unit 1924 is greater than the edge threshold, and the pixel data of the center sub-pixel unit 1922 is greater than the pixel data of the first sub-pixel unit 1924, such edge relationship is encoded as digital data "2", which represents that according to the pixel data to be written, it is determined that the luminance of the center sub-pixel unit 1922 is greater than the luminance of the first sub-pixel unit 1924 and a difference thereof exceeds the edge threshold. In the present embodiment, according to such driving method, the color displayed by the first color sub-pixel B of the center sub-pixel unit 1922 is diffused to the color of the neighboring third color sub-pixel G. Therefore, in view of the whole specified intensity map of the map display unit 1920, the luminance of the first color of the center sub-pixel unit 1922 occupies a share of 2/3, and the luminance of the first color of the second sub-pixel unit 1926 occupies a share of 1/3.

If the data difference between the center sub-pixel unit 1922 and the first sub-pixel unit 1924 is greater than the edge threshold, and the pixel data of the center sub-pixel unit 1922 is smaller than the pixel data of the first sub-pixel unit 1924, such edge relationship is encoded as digital data "8", which represents that according to the pixel data to be written, it is determined that the luminance of the center sub-pixel unit 1922 is smaller than the luminance of the first sub-pixel unit 1924 and a difference thereof exceeds the edge threshold. In the present embodiment, according to such driving method, the color displayed by the second color sub-pixel R of the center sub-pixel unit 1922 is diffused to the color of the neighboring third color sub-pixel G. Therefore, in view of the whole specified intensity map of the map display unit 1920, the luminance of the first color of the center sub-pixel unit 1922 occupies a share of 2/3, and the luminance of the first color of the first sub-pixel unit 1924 occupies a share of 1/3.

Therefore, in the present embodiment, the display driver 110 drives the center sub-pixel unit 1922 and the first sub-pixel unit 1924 to operate in collaboration to display the specified intensity map according to the edge relationship encoded as the digital data "2" or "8", so as to achieve the sub-pixel color diffusion effect.

Referring to FIG. 19C, in the present embodiment, after determination, if a data difference between the center sub-pixel unit 1922 and the first sub-pixel unit 1924 and a data difference between the center sub-pixel unit 1922 and the second sub-pixel unit 1926 are all greater than the edge threshold, and the pixel data of the center sub-pixel unit 1922 is greater than the pixel data of the first sub-pixel unit 1924 and the pixel data of the second sub-pixel unit 1926, the display driver 110 drives the center sub-pixel unit 1922, the first sub-pixel unit 1924 and the second sub-pixel unit 1926 to operate in collaboration to display the specified intensity map, so as to achieve a sub-pixel color diffusion effect. In the present embodiment, such edge relationship is encoded as digital data "3", which represents that according to the pixel data to be written, it is determined that the luminance of the center sub-pixel unit 1922 is the greatest among the luminance of the three sub-pixel units, and a difference thereof exceeds the edge threshold. Therefore, in the present embodiment, the display driver 110 drives the center sub-pixel unit 1922, the first sub-pixel unit 1924 and the second sub-pixel unit 1926 to operate in collaboration to display the specified intensity map according to the edge relationship encoded as the digital data "3", so as to achieve the sub-pixel color diffusion effect. In the present embodiment, according to such driving method, the colors displayed by the first color sub-pixel B and the second color sub-pixel R of the center sub-pixel unit 1922 are diffused to the color of the neighboring third color sub-pixels G. Therefore, in view of the whole specified intensity map of the map display unit 1920, the luminance of the first color of the center sub-pixel unit 1922 occupies a share of 2/3, and the luminance of the first color of the first sub-pixel unit 1924 occupies a share of 1/3. The luminance of the second color of the center sub-pixel unit 1922 occupies a share of 2/3, and the luminance of the second color of the second sub-pixel unit 1926 occupies a share of 1/3.

Moreover, in the present embodiment, after determination, if the data difference between the center sub-pixel unit 1922 and the first sub-pixel unit 1924 and the data difference between the center sub-pixel unit 1922 and the second sub-pixel unit 1926 are all greater than the edge threshold, and the pixel data of the center sub-pixel unit 1922 is smaller than the pixel data of the first sub-pixel unit 1924 and the pixel data of the second sub-pixel unit 1926, the display driver 110 drives the center sub-pixel unit 1922, the first sub-pixel unit 1924 and the second sub-pixel unit 1926 to operate in collaboration to display the specified intensity map, so as to achieve the sub-pixel color diffusion effect. In the present embodiment, such edge relationship is encoded as digital data "12", which represents that according to the pixel data to be written, it is determined that the luminance of the center sub-pixel unit 1922 is the smallest among the luminance of the three sub-pixel units, and a difference thereof exceeds the edge threshold. Therefore, in the present embodiment, the display driver 110 drives the center sub-pixel unit 1922, the first sub-pixel unit 1924 and the second sub-pixel unit 1926 to operate in collaboration to display the specified intensity map according to the edge relationship encoded as the digital data "12", so as to achieve the sub-pixel color diffusion effect. In the present embodiment, according to such driving method, the colors displayed by the first color sub-pixel B and the second color sub-pixel R of the center sub-pixel unit 1922 are diffused to the color of the neighboring third color sub-pixels G. Therefore, in view of the whole specified intensity map of the map display unit 1920, the luminance of the first color of the center sub-pixel unit 1922 occupies a share of 1/3, and the luminance of the first color of the first sub-pixel unit 1924 occupies a share of 2/3. The luminance of the second color of the center sub-pixel unit 1922 occupies a share of 1/3, and the luminance of the second color of the second sub-pixel unit 1926 occupies a share of 2/3.

Therefore, in the present embodiment, the display driver 110 drives the center sub-pixel unit 1922, the first sub-pixel unit 1924 and the second sub-pixel unit 1926 to operate in collaboration to display the specified intensity map according to the edge relationship encoded as the digital data "3" or "12", so as to achieve the sub-pixel color diffusion effect.

Figure 20A:
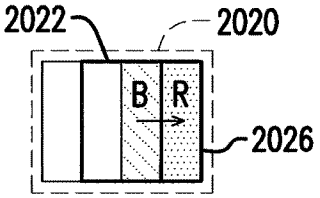
FIG. 20A to FIG. 20C are schematic diagrams of a display driver driving a second type center sub-pixel unit according to an edge relationship according to another embodiment of the invention.
Figure 20B:
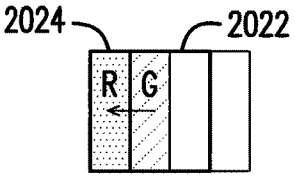
Figure 20C:
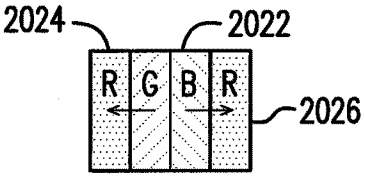

FIG. 20A to FIG. 20C are schematic diagrams of the display driver driving the second type center sub-pixel unit according to the edge relationship according to another embodiment of the invention. Referring to FIG. 20A to FIG. 20C, the center sub-pixel unit 2022 of the present embodiment is, for example, the second type center sub-pixel unit, which includes the third color sub-pixel G and the first color sub-pixel B. The neighboring sub-pixel units include a first sub-pixel unit 2024 and a second sub-pixel unit 2026. The first sub-pixel unit 2024 and the second sub-pixel unit 2026 respectively include a single second color sub-pixel R. In the present embodiment, the display driver 110 determines an edge relationship of the map display unit 2020 according to the pixel data written into the center sub-pixel unit 2022, the first sub-pixel unit 2024 and the second sub-pixel unit 2026 and an edge threshold.

Referring to FIG. 20A, in the present embodiment, after determination, if a data difference between the center sub-pixel unit 2022 and the second sub-pixel unit 2026 is greater than the edge threshold, the display driver 110 drives the center sub-pixel unit 2022 and the second sub-pixel unit 2026 to operate in collaboration to display the specified intensity map, so as to achieve the sub-pixel color diffusion effect. In the present embodiment, if the data difference between the center sub-pixel unit 2022 and the second sub-pixel unit 2026 is greater than the edge threshold, and the pixel data of the center sub-pixel unit 2022 is greater than the pixel data of the second sub-pixel unit 2026, such edge relationship is encoded as digital data "1", which represents that according to the pixel data to be written, it is determined that the luminance of the center sub-pixel unit 2022 is greater than the luminance of the second sub-pixel unit 2026 and a difference thereof exceeds the edge threshold. In the present embodiment, according to such driving method, the color displayed by the second color sub-pixel R of the center sub-pixel unit 2022 is diffused to the color of the neighboring second color sub-pixel R. Therefore, in view of the whole specified intensity map of the map display unit 2020, the luminance of the first color of the center sub-pixel unit 2022 occupies a share of 2/3, and the luminance of the first color of the second sub-pixel unit 2026 occupies a share of 1/3.

Therefore, in the present embodiment, the display driver 110 drives the center sub-pixel unit 2022 and the second sub-pixel unit 2026 to operate in collaboration to display the specified intensity map according to the edge relationship encoded as the digital data "1", so as to achieve the sub-pixel color diffusion effect.

Referring to FIG. 20B, in the present embodiment, after determination, if a data difference between the center sub-pixel unit 2022 and the first sub-pixel unit 2024 is greater than the edge threshold, the display driver 110 drives the center sub-pixel unit 2022 and the first sub-pixel unit 2024 to operate in collaboration to display the specified intensity map, so as to achieve a sub-pixel color diffusion effect. In this example, if the data difference between the center sub-pixel unit 2022 and the first sub-pixel unit 2024 is greater than the edge threshold, and the pixel data of the center sub-pixel unit 2022 is greater than the pixel data of the first sub-pixel unit 2024, such edge relationship is encoded as digital data "2", which represents that according to the pixel data to be written, it is determined that the luminance of the center sub-pixel unit 2022 is greater than the luminance of the first sub-pixel unit 2024 and a difference thereof exceeds the edge threshold. In the present embodiment, according to such driving method, the color displayed by the third color sub-pixel G of the center sub-pixel unit 2022 is diffused to the color of the neighboring second color sub-pixel R. Therefore, in view of the whole specified intensity map of the map display unit 2020, the luminance of the third color of the center sub-pixel unit 2022 occupies a share of 2/3, and the luminance of the third color of the second sub-pixel unit 2026 occupies a share of 1/3.

Therefore, in the present embodiment, the display driver 110 drives the center sub-pixel unit 2022 and the first sub-pixel unit 2024 to operate in collaboration to display the specified intensity map according to the edge relationship encoded as the digital data "2", so as to achieve the sub-pixel color diffusion effect.

Moreover, in the present embodiment, if the data difference between the center sub-pixel unit 2022 and the second sub-pixel unit 2026 is greater than the edge threshold, and the pixel data of the center sub-pixel unit 2022 is smaller than the pixel data of the second sub-pixel unit 2026, such edge relationship is encoded as digital data "4", which represents that according to the pixel data to be written, it is determined that the luminance of the center sub-pixel unit 2022 is smaller than the luminance of the second sub-pixel unit 2026 and a difference thereof exceeds the edge threshold. In the present embodiment, according to such driving method, the color displayed by the third color sub-pixel G of the center sub-pixel unit 2022 is diffused to the color of the neighboring second color sub-pixel R. Therefore, in view of the whole specified intensity map of the map display unit 2020, the luminance of the third color of the center sub-pixel unit 2022 occupies a share of 2/3, and the luminance of the third color of the first sub-pixel unit 2024 occupies a share of 1/3.

Therefore, in the present embodiment, the display driver 110 drives the center sub-pixel unit 2022 and the first sub-pixel unit 2024 to operate in collaboration to display the specified intensity map according to the edge relationship encoded as the digital data "4", so as to achieve the sub-pixel color diffusion effect.

Referring to FIG. 20C, in the present embodiment, after determination, if a data difference between the center sub-pixel unit 2022 and the first sub-pixel unit 2024 and a data difference between the center sub-pixel unit 2022 and the second sub-pixel unit 2026 are all greater than the edge threshold, and the pixel data of the center sub-pixel unit 2022 is greater than the pixel data of the first sub-pixel unit 2024 and the pixel data of the second sub-pixel unit 2026, the display driver 110 drives the center sub-pixel unit 2022, the first sub-pixel unit 2024 and the second sub-pixel unit 2026 to operate in collaboration to display the specified intensity map, so as to achieve the sub-pixel color diffusion effect. In the present embodiment, such edge relationship is encoded as digital data "3", which represents that according to the pixel data to be written, it is determined that the luminance of the center sub-pixel unit 2022 is the greatest among the luminance of the three sub-pixel units, and a difference thereof exceeds the edge threshold. Therefore, in the present embodiment, the display driver 110 drives the center sub-pixel unit 2022, the first sub-pixel unit 2024 and the second sub-pixel unit 2026 to operate in collaboration to display the specified intensity map according to the edge relationship encoded as the digital data "3", so as to achieve the sub-pixel color diffusion effect. In the present embodiment, according to such driving method, the colors displayed by the third color sub-pixel G and the first color sub-pixel B of the center sub-pixel unit 2022 are diffused to the color of the neighboring second color sub-pixels R. Therefore, in view of the whole specified intensity map of the map display unit 2020, the luminance of the third color of the center sub-pixel unit 2022 occupies a share of 2/3, and the luminance of the third color of the first sub-pixel unit 2024 occupies a share of 1/3. The luminance of the first color of the center sub-pixel unit 2022 occupies a share of 2/3, and the luminance of the first color of the second sub-pixel unit 2026 occupies a share of 1/3.

Moreover, in the present embodiment, after determination, if the data difference between the center sub-pixel unit 2022 and the first sub-pixel unit 2024 and the data difference between the center sub-pixel unit 2022 and the second sub-pixel unit 2026 are all greater than the edge threshold, and the pixel data of the center sub-pixel unit 2022 is smaller than the pixel data of the first sub-pixel unit 2024 and the pixel data of the second sub-pixel unit 2026, the display driver 110 drives the center sub-pixel unit 2022, the first sub-pixel unit 2024 and the second sub-pixel unit 2026 to operate in collaboration to display the specified intensity map, so as to achieve the sub-pixel color diffusion effect. In the present embodiment, such edge relationship is encoded as digital data "12", which represents that according to the pixel data to be written, it is determined that the luminance of the center sub-pixel unit 2022 is the smallest among the luminance of the three sub-pixel units, and a difference thereof exceeds the edge threshold. Therefore, in the present embodiment, the display driver 110 drives the center sub-pixel unit 2022, the first sub-pixel unit 2024 and the second sub-pixel unit 2026 to operate in collaboration to display the specified intensity map according to the edge relationship encoded as the digital data "12", so as to achieve the sub-pixel color diffusion effect. In the present embodiment, according to such driving method, the colors displayed by the third color sub-pixel G and the first color sub-pixel B of the center sub-pixel unit 2022 are diffused to the color of the neighboring second color sub-pixels R. Therefore, in view of the whole specified intensity map of the map display unit 2020, the luminance of the third color of the center sub-pixel unit 2022 occupies a share of 2/3, and the luminance of the third color of the first sub-pixel unit 2024 occupies a share of 1/3. The luminance of the first color of the center sub-pixel unit 2022 occupies a share of 2/3, and the luminance of the first color of the second sub-pixel unit 2026 occupies a share of 1/3.

Therefore, in the present embodiment, the display driver 110 drives the center sub-pixel unit 2022, the first sub-pixel unit 2024 and the second sub-pixel unit 2026 to operate in collaboration to display the specified intensity map according to the edge relationship encoded as the digital data "3" or "12", so as to achieve the sub-pixel color diffusion effect.

Figure 21A:
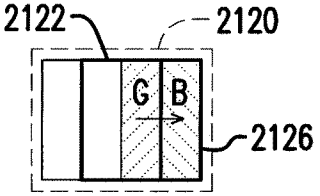
FIG. 21A to FIG. 21C are schematic diagrams of a display driver driving a third type center sub-pixel unit according to an edge relationship according to another embodiment of the invention.
Figure 21B:
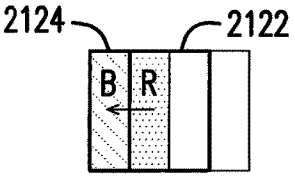
Figure 21C:
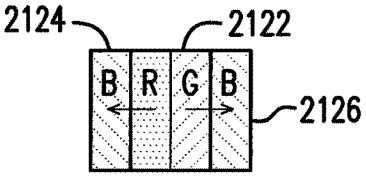

FIG. 21A to FIG. 21C are schematic diagrams of the display driver driving the third type center sub-pixel unit according to the edge relationship according to another embodiment of the invention. Referring to FIG. 21A to FIG. 21C, the center sub-pixel unit 2122 of the present embodiment is, for example, the third type center sub-pixel unit, which includes the second color sub-pixel R and the third color sub-pixel G. The neighboring sub-pixel units include a first sub-pixel unit 2124 and a second sub-pixel unit 2126. The first sub-pixel unit 2124 and the second sub-pixel unit 2126 respectively include a single first color sub-pixel B. In the present embodiment, the display driver 110 determines an edge relationship of the map display unit 2120 according to the pixel data written into the center sub-pixel unit 2122, the first sub-pixel unit 2124 and the second sub-pixel unit 2126 and an edge threshold.

Referring to FIG. 21A, in the present embodiment, after determination, if a data difference between the center sub-pixel unit 2122 and the second sub-pixel unit 2126 is greater than the edge threshold, the display driver 110 drives the center sub-pixel unit 2122 and the second sub-pixel unit 2126 to operate in collaboration to display the specified intensity map, so as to achieve the sub-pixel color diffusion effect. In the present embodiment, if the data difference between the center sub-pixel unit 2122 and the second sub-pixel unit 2126 is greater than the edge threshold, and the pixel data of the center sub-pixel unit 2122 is greater than the pixel data of the second sub-pixel unit 2126, such edge relationship is encoded as digital data "1", which represents that according to the pixel data to be written, it is determined that the luminance of the center sub-pixel unit 2122 is greater than the luminance of the second sub-pixel unit 2126 and a difference thereof exceeds the edge threshold. In the present embodiment, according to such driving method, the color displayed by the third color sub-pixel G of the center sub-pixel unit 2122 is diffused to the color of the neighboring first color sub-pixel B. Therefore, in view of the whole specified intensity map of the map display unit 2120, the luminance of the third color of the center sub-pixel unit 2122 occupies a share of 2/3, and the luminance of the third color of the second sub-pixel unit 2126 occupies a share of 1/3.

Therefore, in the present embodiment, the display driver 110 drives the center sub-pixel unit 2122 and the second sub-pixel unit 2126 to operate in collaboration to display the specified intensity map according to the edge relationship encoded as the digital data "1", so as to achieve the sub-pixel color diffusion effect.

Moreover, in the present embodiment, if the data difference between the center sub-pixel unit 2122 and the first sub-pixel unit 2124 is greater than the edge threshold, and the pixel data of the center sub-pixel unit 2122 is smaller than the pixel data of the first sub-pixel unit 2124, such edge relationship is encoded as digital data "8", which represents that according to the pixel data to be written, it is determined that the luminance of the center sub-pixel unit 2122 is smaller than the luminance of the first sub-pixel unit 2124 and a difference thereof exceeds the edge threshold. In the present embodiment, according to such driving method, the color displayed by the third color sub-pixel G of the center sub-pixel unit 2122 is diffused to the color of the neighboring first color sub-pixel B. Therefore, in view of the whole specified intensity map of the map display unit 2120, the luminance of the third color of the center sub-pixel unit 2122 occupies a share of 2/3, and the luminance of the third color of the second sub-pixel unit 2126 occupies a share of 1/3.

Therefore, in the present embodiment, the display driver 110 drives the center sub-pixel unit 2122 and the second sub-pixel unit 2126 to operate in collaboration to display the specified intensity map according to the edge relationship encoded as the digital data "8", so as to achieve the sub-pixel color diffusion effect.

Referring to FIG. 21B, in the present embodiment, after determination, if a data difference between the center sub-pixel unit 2122 and the first sub-pixel unit 2124 is greater than the edge threshold, the display driver 110 drives the center sub-pixel unit 2122 and the first sub-pixel unit 2124 to operate in collaboration to display the specified intensity map, so as to achieve a sub-pixel color diffusion effect. In this example, if the data difference between the center sub-pixel unit 2122 and the first sub-pixel unit 2124 is greater than the edge threshold, and the pixel data of the center sub-pixel unit 2122 is greater than the pixel data of the first sub-pixel unit 2124, such edge relationship is encoded as digital data "2", which represents that according to the pixel data to be written, it is determined that the luminance of the center sub-pixel unit 2122 is greater than the luminance of the first sub-pixel unit 2124 and a difference thereof exceeds the edge threshold. In the present embodiment, according to such driving method, the color displayed by the second color sub-pixel R of the center sub-pixel unit 2122 is diffused to the color of the neighboring first color sub-pixel B. Therefore, in view of the whole specified intensity map of the map display unit 2120, the luminance of the second color of the center sub-pixel unit 2122 occupies a share of 2/3, and the luminance of the second color of the first sub-pixel unit 2124 occupies a share of 1/3.

Therefore, in the present embodiment, the display driver 110 drives the center sub-pixel unit 2122 and the first sub-pixel unit 2124 to operate in collaboration to display the specified intensity map according to the edge relationship encoded as the digital data "2", so as to achieve the sub-pixel color diffusion effect.

Referring to FIG. 2C, in the present embodiment, after determination, if a data difference between the center sub-pixel unit 2122 and the first sub-pixel unit 2124 and a data difference between the center sub-pixel unit 2122 and the second sub-pixel unit 2126 are all greater than the edge threshold, and the pixel data of the center sub-pixel unit 2122 is greater than the pixel data of the first sub-pixel unit 2124 and the pixel data of the second sub-pixel unit 2126, the display driver 110 drives the center sub-pixel unit 2122, the first sub-pixel unit 2124 and the second sub-pixel unit 2126 to operate in collaboration to display the specified intensity map, so as to achieve the sub-pixel color diffusion effect. In the present embodiment, such edge relationship is encoded as digital data "3", which represents that according to the pixel data to be written, it is determined that the luminance of the center sub-pixel unit 2122 is the greatest among the luminance of the three sub-pixel units, and a difference thereof exceeds the edge threshold. Therefore, in the present embodiment, the display driver 110 drives the center sub-pixel unit 2122, the first sub-pixel unit 2124 and the second sub-pixel unit 2126 to operate in collaboration to display the specified intensity map according to the edge relationship encoded as the digital data "3", so as to achieve the sub-pixel color diffusion effect. In the present embodiment, according to such driving method, the colors displayed by the second color sub-pixel R and the third color sub-pixel G of the center sub-pixel unit 2022 are diffused to the color of the neighboring first color sub-pixels B. Therefore, in view of the whole specified intensity map of the map display unit 2120, the luminance of the second color of the center sub-pixel unit 2122 occupies a share of 2/3, and the luminance of the second color of the first sub-pixel unit 2124 occupies a share of 1/3. The luminance of the third color of the center sub-pixel unit 2122 occupies a share of 2/3, and the luminance of the third color of the second sub-pixel unit 2126 occupies a share of 1/3.

Moreover, in the present embodiment, after determination, if the data difference between the center sub-pixel unit 2122 and the first sub-pixel unit 2124 and the data difference between the center sub-pixel unit 2122 and the second sub-pixel unit 2126 are all greater than the edge threshold, and the pixel data of the center sub-pixel unit 2122 is smaller than the pixel data of the first sub-pixel unit 2124 and the pixel data of the second sub-pixel unit 2126, the display driver 110 drives the center sub-pixel unit 2122, the first sub-pixel unit 2124 and the second sub-pixel unit 2126 to operate in collaboration to display the specified intensity map, so as to achieve the sub-pixel color diffusion effect. In the present embodiment, such edge relationship is encoded as digital data "12", which represents that according to the pixel data to be written, it is determined that the luminance of the center sub-pixel unit 2122 is the smallest among the luminance of the three sub-pixel units, and a difference thereof exceeds the edge threshold. Therefore, in the present embodiment, the display driver 110 drives the center sub-pixel unit 2122, the first sub-pixel unit 2124 and the second sub-pixel unit 2126 to operate in collaboration to display the specified intensity map according to the edge relationship encoded as the digital data "12", so as to achieve the sub-pixel color diffusion effect. In the present embodiment, according to such driving method, the colors displayed by the second color sub-pixel R and the third color sub-pixel G of the center sub-pixel unit 2122 are diffused to the color of the neighboring first color sub-pixels B. Therefore, in view of the whole specified intensity map of the map display unit 2120, the luminance of the second color of the center sub-pixel unit 2122 occupies a share of 2/3, and the luminance of the second color of the first sub-pixel unit 2124 occupies a share of 1/3. The luminance of the third color of the center sub-pixel unit 2122 occupies a share of 2/3, and the luminance of the third color of the second sub-pixel unit 2126 occupies a share of 1/3.

Therefore, in the present embodiment, the display driver 110 drives the center sub-pixel unit 2122, the first sub-pixel unit 2124 and the second sub-pixel unit 2126 to operate in collaboration to display the specified intensity map according to the edge relationship encoded as the digital data "3" or "12", so as to achieve the sub-pixel color diffusion effect.

Figure 22:
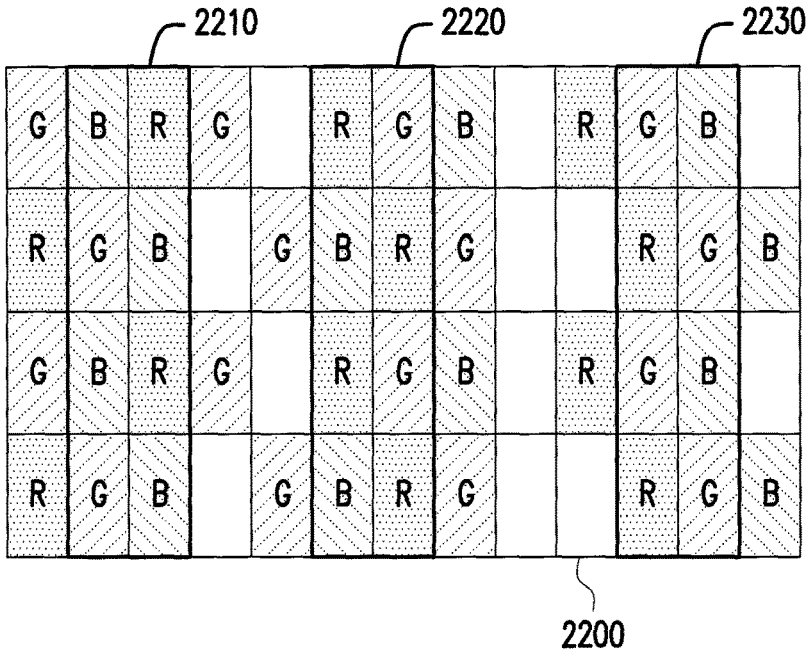
FIG. 22 is a schematic diagram of a pixel array displaying a plurality of specified intensity maps in overall according to another embodiment of the invention.

FIG. 22 is a schematic diagram of a pixel array displaying a plurality of specified intensity maps in overall according to another embodiment of the invention. Referring to FIG. 22, in the present embodiment, the display driver 110 applies the display driving method of the invention to drive the pixel array 2200 to display a plurality of specified intensity maps of an image. In this example, on vertical lines 2210, 2220 and 2230 of the pixel array 2200, the center sub-pixel unit and the neighboring sub-pixel units of each vertical line operate in collaboration to display a luminance with a summation thereof reaching 2 unit intensities.

Figure 23:
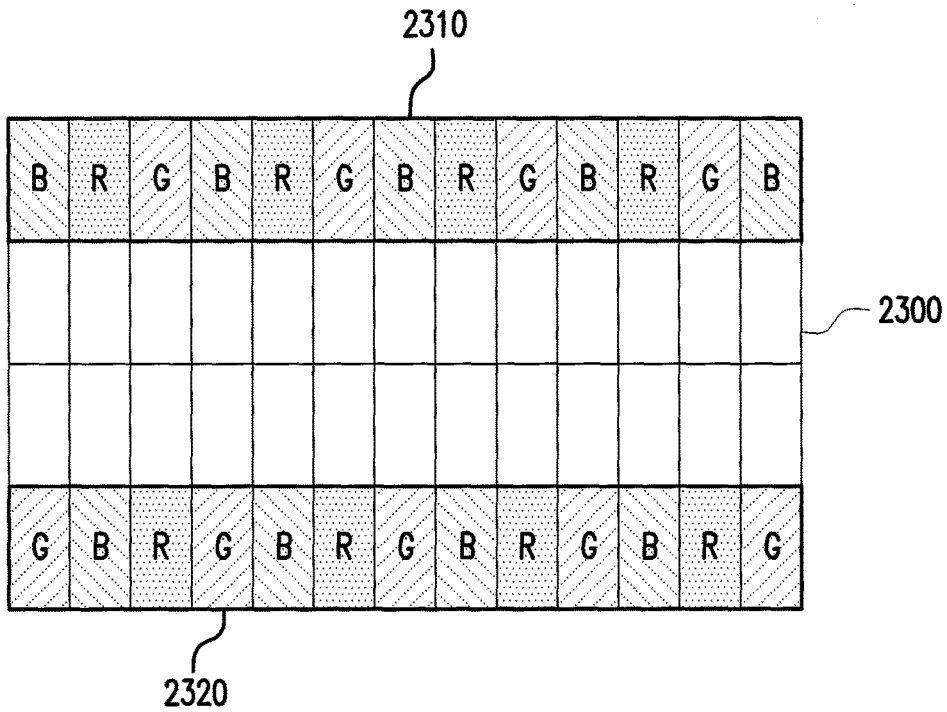
FIG. 23 is a schematic diagram of a pixel array displaying a plurality of specified intensity maps in overall according to another embodiment of the invention.

FIG. 23 is a schematic diagram of a pixel array displaying a plurality of specified intensity maps in overall according to another embodiment of the invention. Referring to FIG. 23, in the present embodiment, the display driver 110 applies the display driving method of the invention to drive the pixel array 2300 to display a plurality of specified intensity maps of an image. In this example, on horizontal lines 2310 and 2320 of the pixel array 2300, the first color sub-pixel B, the second color sub-pixel R and the third color sub-pixel G of each horizontal line operate in collaboration to display a luminance with a summation thereof reaching 2 unit intensities.

Figure 24:
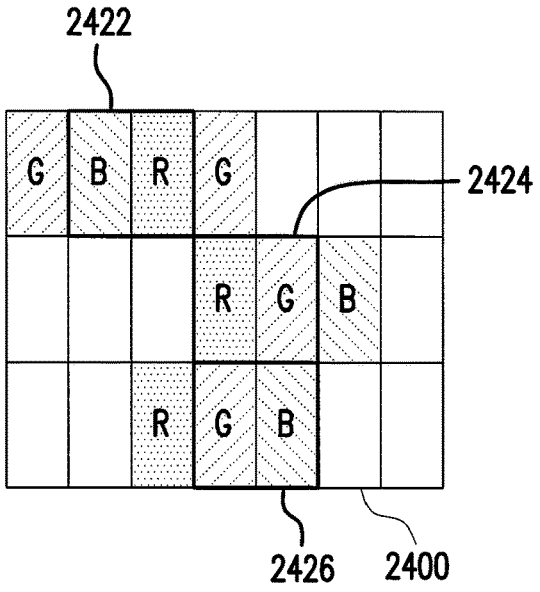
FIG. 24 is a schematic diagram of a pixel array displaying a plurality of specified intensity maps in overall according to another embodiment of the invention.

FIG. 24 is a schematic diagram of a pixel array displaying a plurality of specified intensity maps in overall according to another embodiment of the invention. Referring to FIG. 24, in the present embodiment, the display driver 110 applies the display driving method of the invention to drive the pixel array 2400 to display a plurality of specified intensity maps of an image. In this example, the pixel array 2400 displays a plurality of fourth color map points, where the center sub-pixel units 2422, 2424 and 2426 and the corresponding neighboring sub-pixel units operate in collaboration to display the fourth color.

In the invention, the overall specified intensity maps of the pixel arrays shown in FIG. 22 to FIG. 24 are only examples, and the invention is not limited thereto. In the plurality of specified intensity maps shown in FIG. 22 to FIG. 24, when the observer observes the specified intensity maps, a visual center thereof approximately focuses on the center of each of the specified intensity maps. In an embodiment, according to the display driving method disclosed by FIG. 13 to FIG. 21C, the overall specified intensity map of the 3/2X data mapping pixel array may have other implementations, which are not limited by the invention.

Therefore, in the embodiments of FIG. 13 to FIG. 24, the display driver 110 writes the pixel data into the pixel array in the data mapping method of a second rate (3/2X), and when the pixel array is driven, the color displayed by each sub-pixel is diffused in the horizontal direction, so as to provide good display quality while at least considering the display luminance.

Figure 25:
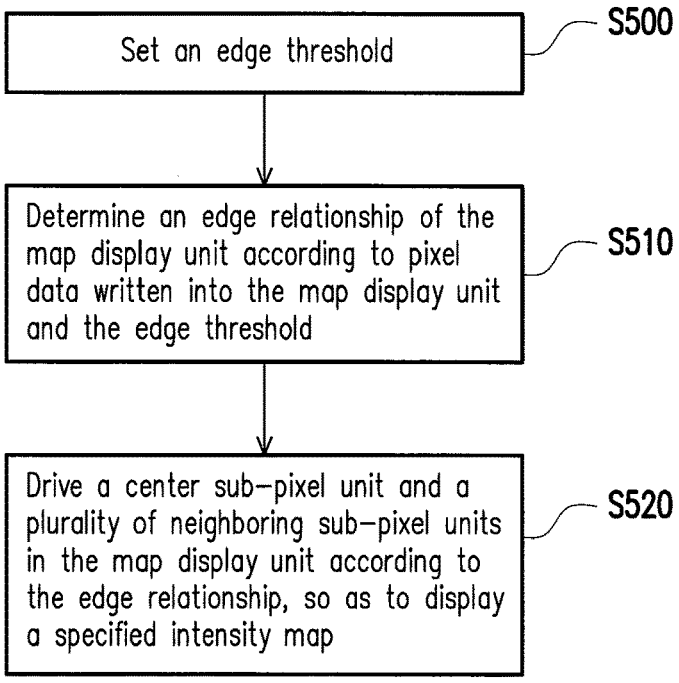
FIG. 25 is a flowchart illustrating a display driving method according to an embodiment of the invention.

FIG. 25 is a flowchart illustrating a display driving method according to an embodiment of the invention. The display driving method is, for example, at least applied to the display apparatus 100 of FIG. 1. The display driving method includes following steps. Taking FIG. 4 as an example, and referring to FIG. 1, FIG. 4 and FIG. 25, in step S500, an edge threshold is set. Then, in step S510, the display driver 110 determines an edge relationship of the map display unit 410 according to pixel data written into the map display unit 410 and the edge threshold. Then, in step S520, the display driver 110 drives a center sub-pixel unit and a plurality of neighboring sub-pixel units in the map display unit 410 according to the edge relationship, so as to display the specified intensity map.

Moreover, since those skilled in the art can learn enough instructions and recommendations of the display driving method of the invention from the descriptions of the embodiments of FIG. 1 to FIG. 24, detailed description thereof is not repeated.

FIG. 26A to FIG. 26E are schematic diagrams of map display units of different embodiments of the invention. Referring to FIG. 1, FIG. 3 and FIG. 26A to FIG. 26E, in the embodiments of FIG. 26A to FIG. 26E, the display driver 110, for example, respectively writes corresponding pixel data into map display units 2620A to 2620E in the 2X data mapping method. The map display units 2620A to 2620E can be map display units on the same or different pixel arrays. In the embodiments of FIG. 26A to FIG. 26E, the map display units 2620A to 2620E, for example, respectively display one, two, three, four and five white pixel points. In FIG. 26A to FIG. 26E, parameters x and y indicated on each of the sub-pixels are luminance proportions, where $0 \leq x \leq 100\%$ and $0 \leq y \leq 100\%$. The sub-pixel indicated by "1" presents that the luminance thereof is 100%.

Figure 26A:
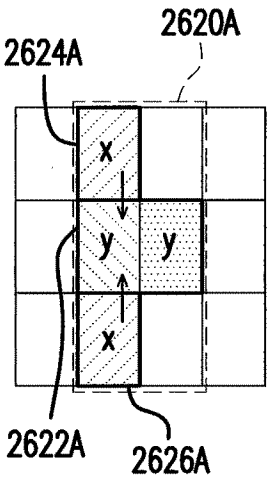
FIG. 26A to FIG. 26E are schematic diagrams of map display units of different embodiments of the invention.

To be specific, in the embodiment of FIG. 26A, the display driver 110 drives the map display unit 2620A according to the edge relationship of the map display unit 2620A, so as to make a center sub-pixel unit 2622A and neighboring sub-pixel units 2624A and 2626A to display the specified intensity map, for example, the one white pixel point. In FIG. 26A, the center sub-pixel unit 2622A, for example, includes a blue sub-pixel and a red sub-pixel, and luminance proportions thereof are respectively y. The neighboring sub-pixel units 2624A and 2626A, for example, respectively include a green sub-pixel, and a luminance proportion thereof is x. In the embodiment of the FIG. 26A, the specified intensity map is complied with a first equation $y=2X$, which represents that in the map display unit 2620A, luminance summations of the sub-pixels of different colors are equal. For example, the luminance summation of the green sub-pixels is 2X, the luminance summation of the blue sub-pixels is y, and the luminance summation of the red sub-pixels is also y, such that the luminance summations of the sub-pixels of the three colors are equal.

Generally, in a display panel driven by using the sub-pixel rending (SPR) method, an area of the sub-pixels thereof (which are referred to as SPR sub-pixels hereinafter) is greater than an area of sub-pixels (which are referred to as non-SPR sub-pixels hereinafter) of a display panel driven by a method other than the SPR method. Therefore, a luminance required by the SPR sub-pixels for displaying one white pixel point is lower than that of the non-SPR sub-pixels. In the 2X data mapping driving method, for example, when the one white pixel point is displayed, the luminance of the blue SPR sub-pixel, the red SPR sub-pixel and the green SPR sub-pixel is only ½ of the luminance of the non-SPR sub-pixel. Therefore, when the two white pixel points are displayed, a luminance summation of the blue SPR sub-pixel, the red SPR sub-pixel and the green SPR sub-pixel is twice of the luminance used for displaying the one white pixel point, i.e. 1. When the other number of the white pixel points are displayed, the luminance of the SPR sub-pixel of different colors can be deduced by analogy.

Figure 26B:
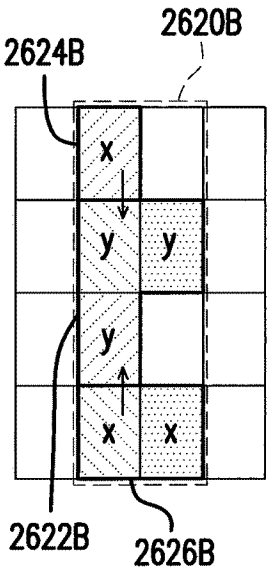

In the embodiment of FIG. 26B, the display driver 110 drives the map display unit 2620B according to the edge relationship of the map display unit 2620B, so as to make a center sub-pixel unit 2622B and neighboring sub-pixel units 2624B and 2626B to display the specified intensity map, for example, the two white pixel points. In FIG. 26B, the center sub-pixel unit 2622B, for example, includes a blue sub-pixel, a red sub-pixel and a green sub-pixel, and luminance proportions thereof are respectively y. The neighboring sub-pixel unit 2624B, for example, includes a green sub-pixel, and a luminance proportion thereof is x. The neighboring sub-pixel unit 2626B, for example, includes a blue sub-pixel and a red sub-pixel, and luminance proportions thereof are respectively x. In the embodiment of the FIG. 26B, luminance summations of the blue sub-pixels, the red sub-pixels and the green sub-pixels are equal, which are respectively x+y. Moreover, when the two white pixel points are displayed, the respective luminance summation of the blue sub-pixels, the red sub-pixels and the green sub-pixels is twice of the luminance summation of the sub-pixels of different colors when one white pixel point is displayed, i.e. 1. Therefore, the specified intensity map of the map display unit 2620B is complied with a second equation $x+y=1$. Based on the same concept, in the embodiment of FIG. 26D, the luminance summations of the blue sub-pixels, the red sub-pixels and the green sub-pixels are equal, which are respectively x+y+1. Moreover, when the four white pixel points are displayed, the respective luminance summation of the blue sub-pixels, the red sub-pixels and the green sub-pixels is four times of the luminance summation of the sub-pixels of different colors when the one white pixel point is displayed, i.e. 2. Therefore, the specified intensity map of the map display unit 2620D is also complied with the second equation $x+y=1$.

Figure 26C:
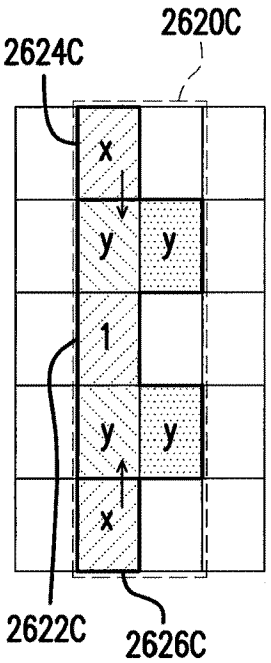
Figure 26D:
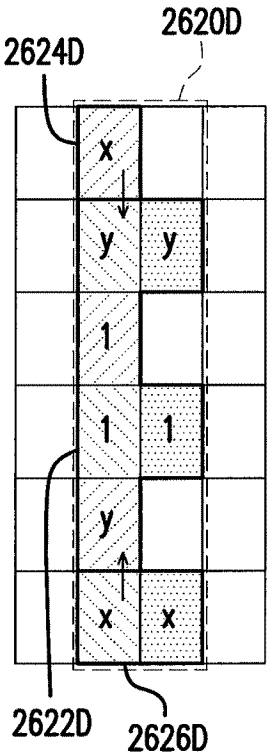

In the embodiment of FIG. 26C, the display driver 110 drives the map display unit 2620C according to the edge relationship of the map display unit 2620C, so as to make a center sub-pixel unit 2622C and neighboring sub-pixel units 2624C and 2626C to display the specified intensity map, for example, the three white pixel points. In FIG. 26C, the center sub-pixel unit 2622C, for example, includes two blue sub-pixel, one green sub-pixel and two red sub-pixels. Luminance proportions of the blue sub-pixels are respectively y, and a luminance proportion of the green sub-pixel is 1. The neighboring sub-pixel units 2624C and 2626C, for example, respectively include one green sub-pixel, and a luminance proportion thereof is x. In the embodiment of the FIG. 26C, the specified intensity map thereof is complied with a third equation $y=x+½$, which represents that in the map display unit 2620C, the luminance summations of the sub-pixels of different colors are equal. For example, the luminance summation of the green sub-pixels is 2x+1, the luminance summations of the blue sub-pixels and the red sub-pixels are respectively 2y, so that the luminance summations of the sub-pixels of the three colors are the same.

Figure 26E:
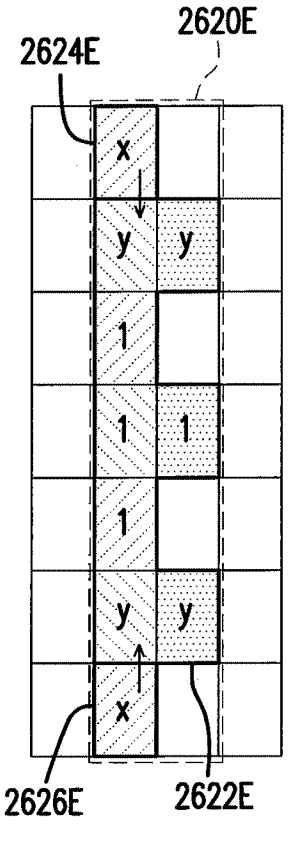

Based on the same concept, in the embodiment of FIG. 26E, the luminance summations of the blue sub-pixels, the red sub-pixels and the green sub-pixels are equal, which are respectively 2y+1. 2y+1, 2x+2, and the luminance summations thereof are equal. Therefore, the specified intensity map of the map display unit 2620E is also complied with the third equation y=x+½.

In overall, in the embodiments of FIG. 26A to FIG. 26E, when the map display unit displays 2m white pixel points, the specified intensity map of the map display unit is complied with the second equation x+y=1. When the map display unit displays 2m+1 white pixel points, besides displaying one white pixel point, the specified intensity map of the map display unit is complied with the third equation y=x+½, where m is a positive integer greater than 0.

FIG. 27A to FIG. 27F are schematic diagrams of map display units of different embodiments of the invention. Referring to FIG. 1, FIG. 3 and FIG. 27A to FIG. 27F, in the embodiments of FIG. 27A to FIG. 27F, the display driver 110, for example, respectively writes corresponding pixel data into map display units 2720A to 2720F in the 3/2X data mapping method. The map display units 2720A to 2720F can be map display units on the same or different pixel arrays. In the embodiments of FIG. 27A to FIG. 27F, the map display units 2720A to 2720F, for example, respectively display one, two, three, four, five and six white pixel points. In FIG. 27A to FIG. 27F, parameters x and y indicated on each of the sub-pixels are luminance proportions, where 0≤x≤100% and 0≤y≤100%. The sub-pixel indicated by "1" presents that the luminance thereof is 100%.

To be specific, in the embodiment of FIG. 27A, the display driver 110 drives the map display unit 2720A according to the edge relationship of the map display unit 2720A, so as to make a center sub-pixel unit 2722A and neighboring sub-pixel units 2724A and 2726A to display the specified intensity map, for example, the one white pixel point. In FIG. 27A, the center sub-pixel unit 2722A, for example, includes a green sub-pixel and a red sub-pixel, and luminance proportions thereof are respectively y. The neighboring sub-pixel units 2724A and 2726A, for example, respectively include a blue sub-pixel, and a luminance proportion thereof is x. In the embodiment of the FIG. 27A, the specified intensity map is complied with the first equation y=2x, which represents that in the map display unit 2720A, luminance summations of the sub-pixels of different colors are equal. For example, the luminance summation of the blue sub-pixels is 2x, the luminance summation of the green sub-pixels is y, and the luminance summation of the red sub-pixels is also y, such that the luminance summations of the sub-pixels of the three colors are equal. Based on the same concept, in the embodiment of FIG. 27D, the luminance summations of the blue sub-pixels, the red sub-pixels and the green sub-pixels are equal, which are respectively 2x+2, y+2, y+2, and the luminance summations thereof are equal. Therefore, the specified intensity map of the map display unit 2720D is also complied with the first equation y=2x.

In the embodiment of FIG. 27B, the display driver 110 drives the map display unit 2720B according to the edge relationship of the map display unit 2720B, so as to make a center sub-pixel unit 2722B and neighboring sub-pixel units 2724B and 2726B to display the specified intensity map, for example, the two white pixel points. In FIG. 27B, the center sub-pixel unit 2722B, for example, includes one green sub-pixel, one blue sub-pixel and two red sub-pixels, and luminance proportions thereof are respectively 1, 1, 2y. The neighboring sub-pixel unit 2724B and 2726B, for example, respectively include one blue sub-pixel and one green sub-pixel, and a luminance proportion thereof is x. In the embodiment of the FIG. 27B, the specified intensity map thereof is complied with a fourth equation y=x/2+½, which represents that in the map display unit 2720B, the luminance summations of the sub-pixels of different colors are equal. For example, the luminance summation of the blue sub-pixels is x+1, the luminance summation of the green sub-pixels is also x+1, and the luminance summation of the red sub-pixels is 2y, such that the luminance summations of the sub-pixels of the three colors are equal. Based on the same concept, in the embodiment of FIG. 27E, the luminance summations of the blue sub-pixels, the red sub-pixels and the green sub-pixels are equal, which are respectively x+3, 2y+2, x+3, and the luminance summations thereof are equal. Therefore, the specified intensity map of the map display unit 2720E is also complied with the fourth equation y=x/2+½.

In the embodiment of FIG. 27C, the display driver 110 drives the map display unit 2720C according to the edge relationship of the map display unit 2720C, so as to make a center sub-pixel unit 2722C and neighboring sub-pixel units 2724C and 2726C to display the specified intensity map, for example, the three white pixel points. In FIG. 27C, the center sub-pixel unit 2722C, for example, includes two green sub-pixel, two blue sub-pixel and two red sub-pixels. Luminance proportions of the sub-pixels of the three colors are respectively 2, y+1, y+1. The neighboring sub-pixel units 2724C and 2726C, for example, respectively include one blue sub-pixel and one red sub-pixel, and a luminance proportion thereof is x. In the embodiment of the FIG. 27C, the specified intensity map thereof is complied with the second equation x+y=1, which represents that in the map display unit 2720C, the luminance summations of the sub-pixels of different colors are equal. For example, the luminance summation of the blue sub-pixels is x+y+1, the luminance summation of the green sub-pixels is 2, and the luminance summation of the red sub-pixels is also x+y+1, so that the luminance summations of the sub-pixels of the three colors are the same. Based on the same concept, in the embodiment of FIG. 27F, the luminance summations of the blue sub-pixels, the red sub-pixels and the green sub-pixels are equal, which are respectively x+y+3. x+y+3, 4, and the luminance summations thereof are equal. Therefore, the specified intensity map of the map display unit 2720F is also complied with the second equation x+y=1.

In overall, in the embodiments of FIG. 27A to FIG. 27F, when the map display unit displays 3k+1 white pixel points, the specified intensity map of the map display unit is complied with the first equation y=2x. When the map display unit displays 3k+2 white pixel points, the specified intensity map of the map display unit is complied with the fourth equation y=x/2+½. When the map display unit displays 3k+3 white pixel points, the specified intensity map of the map display unit is complied with the second equation x+y=1, where k is a positive integer greater than or equal to 0.

In summary, in the exemplary embodiments of the invention, the display driver drives the map display unit according to the edge relationship of the map display unit, such that at least one of the center sub-pixel unit and the neighboring sub-pixel units displays the specified intensity map. In the exemplary embodiments of the invention, based on the arrangement method of the sub-pixels in the pixel array, when the observer observes the specified intensity maps, a visual center thereof approximately focuses on the center of each of the specified intensity maps, so as to improve the display quality of the display panel.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A display apparatus, comprising:

a display panel, comprising a rectangular sub-pixel repeat array repeatedly arranged to form a pixel array on the display panel, the pixel array comprising at least one map display unit, and the map display unit comprising a center sub-pixel unit and a plurality of neighboring sub-pixel units; and a display driver, coupled to the display panel, and driving the display panel to display an image by using a sub-pixel rendering method, the image comprising at least one specified intensity map, wherein the map display unit is configured to display the specified intensity map, wherein a first color sub-pixel, a second color sub-pixel and a third color sub-pixel are sequentially arranged along a horizontal direction to form a first sub-pixel row of the sub-pixel repeat array, and the third color sub-pixel, the first color sub-pixel and the second color sub-pixel are sequentially arranged along the horizontal direction to form a second sub-pixel row of the sub-pixel repeat array, wherein the specified intensity map comprises one or more white pixel points, and in the map display unit, a luminance summation of the first color sub-pixel, a luminance summation of the second color sub-pixel and a luminance summation of the third color sub-pixel are equal, wherein the center sub-pixel unit and the neighboring sub-pixel units are arranged adjacent to each other along a vertical direction while taking the center sub-pixel unit as a center, wherein when the map display unit displays one white pixel point, the specified intensity map of the map display unit is complied with a first equation, when the map display unit displays 2m white pixel points, the specified intensity map of the map display unit is complied with a second equation, and when the map display unit displays 2m+1 white pixel points, the specified intensity map of the map display unit is complied with a third equation, wherein m is a positive integer greater than 0, wherein luminances of the sub-pixels in the center sub-pixel unit are y or 1 respectively, and luminances of the sub-pixels in the neighboring sub-pixel units are x, wherein the first equation is $y=2x$, the second equation is $x+y=1$, and the third equation is $y=x+\frac{1}{2}$.

2. The display apparatus as claimed in claim 1, wherein the display driver writes pixel data into the pixel array according to a data mapping method of a first rate.

3. The display apparatus as claimed in claim 1, wherein the center sub-pixel unit comprises the first color sub-pixel and the second color sub-pixel, each of the neighboring sub-pixel units comprises the third color sub-pixel, the center sub-pixel unit displays a first color or a second color, the display driver drives the center sub-pixel unit to display the specified intensity map, and a luminance of the center sub-pixel unit is greater than a luminance summation of the neighboring sub-pixel units, and the center sub-pixel unit displays a third color, the display driver drives the neighboring sub-pixel units to display the specified intensity map, and the luminance of the center sub-pixel unit is smaller than the luminance summation of the neighboring sub-pixel units.

4. The display apparatus as claimed in claim 1, wherein the center sub-pixel unit comprises the third color sub-pixel, each of the neighboring sub-pixel units comprises the first color sub-pixel and the second color sub-pixel, the center sub-pixel unit displays a first color or a second color, the display driver drives the neighboring sub-pixel units to display the specified intensity map, and a luminance of the center sub-pixel unit is smaller than a luminance summation of the neighboring sub-pixel units, and the center sub-pixel unit displays a third color, the display driver drives the center sub-pixel unit to display the specified intensity map, and the luminance of the center sub-pixel unit is greater than the luminance summation of the neighboring sub-pixel units.

5. The display apparatus as claimed in claim 1, wherein the center sub-pixel unit displays a white color, the display driver drives the center sub-pixel unit and the neighboring sub-pixel units to operate in collaboration to display the specified intensity map, and a luminance of the center sub-pixel unit is greater than or equal to a luminance summation of the neighboring sub-pixel units.

6. The display apparatus as claimed in claim 1, wherein the display driver drives the map display unit according to an edge relationship of the map display unit, so as to make one of the center sub-pixel unit and the neighboring sub-pixel units to display the specified intensity map.

7. The display apparatus as claimed in claim 1, wherein the neighboring sub-pixel units comprise a first sub-pixel unit and a second sub-pixel unit, the display driver determines the edge relationship of the map display unit according to the pixel data written into the center sub-pixel unit, the first sub-pixel unit and the second sub-pixel unit and an edge threshold.

8. The display apparatus as claimed in claim 7, wherein after determination, if a data difference between the center sub-pixel unit and the first sub-pixel unit is greater than the edge threshold, the display driver drives the center sub-pixel unit and the first sub-pixel unit to display the specified intensity map.

9. The display apparatus as claimed in claim 7, wherein after determination, if a data difference between the center sub-pixel unit and the second sub-pixel unit is greater than the edge threshold, the display driver drives the center sub-pixel unit and the second sub-pixel unit to display the specified intensity map.

10. The display apparatus as claimed in claim 7, wherein after determination, if a data difference between the center sub-pixel unit and the first sub-pixel unit is greater than the edge threshold, and a data difference between the center sub-pixel unit and the second sub-pixel unit is greater than the edge threshold, the display driver drives the center sub-pixel unit, the first sub-pixel unit and the second sub-pixel unit to display the specified intensity map.

11. The display apparatus as claimed in claim 7, wherein after determination, if a data difference between the center sub-pixel unit and the first sub-pixel unit is greater than the edge threshold, a data difference between the center sub-pixel unit and the second sub-pixel unit is greater than the edge threshold, the pixel data of the center sub-pixel unit is smaller than the pixel data of the first sub-pixel unit, and the pixel data of the center sub-pixel unit is smaller than the pixel data of the second sub-pixel unit, the display driver drives the first sub-pixel unit and the second sub-pixel unit to display the specified intensity map.

12. The display apparatus as claimed in claim 7, wherein the center sub-pixel unit comprises the third color sub-pixel, and after determination, if a data difference between the center sub-pixel unit and the first sub-pixel unit is greater than the edge threshold, the display driver drives the center sub-pixel unit and the second sub-pixel unit to display the specified intensity map.

13. The display apparatus as claimed in claim 7, wherein the center sub-pixel unit comprises the third color sub-pixel, and after determination, if a data difference between the center sub-pixel unit and the second sub-pixel unit is greater than the edge threshold, the display driver drives the center sub-pixel unit and the first sub-pixel unit to display the specified intensity map.

14. The display apparatus as claimed in claim 1, wherein the first color sub-pixel and the third color sub-pixel are sequentially arranged along a vertical direction to form a first sub-pixel column of the sub-pixel repeat array, the second color sub-pixel and the first color sub-pixel are sequentially arranged along the vertical direction to form a second sub-pixel column of the sub-pixel repeat array, and the third color sub-pixel and the second color sub-pixel are sequentially arranged along the vertical direction to form a third sub-pixel column of the sub-pixel repeat array.

15. The display apparatus as claimed in claim 1, wherein the first color sub-pixel, the second color sub-pixel and the third color sub-pixel are respectively a blue sub-pixel, a red sub-pixel and a green sub-pixel.

16. A display driving method, adapted to drive a display panel to display an image by using a sub-pixel rendering method, wherein the display panel comprises a pixel array, the pixel array comprises at least one map display unit, and the image comprises at least one specified intensity map, the display driving method comprising:

setting an edge threshold;

determining an edge relationship of the map display unit according to pixel data written into the map display unit and the edge threshold; and driving a center sub-pixel unit and a plurality of neighboring sub-pixel units in the map display unit according to the edge relationship, so as to display the specified intensity map, wherein the neighboring sub-pixel units comprise a first sub-pixel unit and a second sub-pixel unit, and the center sub-pixel unit, the first sub-pixel unit and the second sub-pixel unit are arranged adjacent to each other along a vertical direction while taking the center sub-pixel unit as a center, wherein the specified intensity map comprises one or more white pixel points, and in the map display unit, a luminance summation of the first color sub-pixel, a luminance summation of the second color sub-pixel and a luminance summation of the third color sub-pixel are equal, wherein when the map display unit displays one white pixel point, the specified intensity map of the map display unit is complied with a first equation, when the map display unit displays 2m white pixel points, the specified intensity map of the map display unit is complied with a second equation, and when the map display unit displays 2m+1 white pixel points, the specified intensity map of the map display unit is complied with a third equation, wherein m is a positive integer greater than 0, wherein luminances of the sub-pixels in the center sub-pixel unit are y or 1 respectively, and luminances of the sub-pixels in the neighboring sub-pixel units are x, wherein the first equation is $y=2x$, the second equation is $x+y=1$, and the third equation is $y=x+\frac{1}{2}$.

17. The display driving method as claimed in claim 16, wherein after determination, if a data difference between the center sub-pixel unit and the first sub-pixel unit is greater than the edge threshold, the step of driving the center sub-pixel unit and the neighboring sub-pixel units in the map display unit according to the edge relationship comprises:

driving the center sub-pixel unit and the first sub-pixel unit to display the specified intensity map.

18. The display driving method as claimed in claim 16, wherein after determination, if a data difference between the center sub-pixel unit and the second sub-pixel unit is greater than the edge threshold, the step of driving the center sub-pixel unit and the neighboring sub-pixel units in the map display unit according to the edge relationship comprises:

driving the center sub-pixel unit and the second sub-pixel unit to display the specified intensity map.

19. The display driving method as claimed in claim 16, wherein after determination, if a data difference between the center sub-pixel unit and the first sub-pixel unit is greater than the edge threshold, and a data difference between the center sub-pixel unit and the second sub-pixel unit is greater than the edge threshold, the step of driving the center sub-pixel unit and the neighboring sub-pixel units in the map display unit according to the edge relationship comprises:

driving the center sub-pixel unit, the first sub-pixel unit and the second sub-pixel unit to display the specified intensity map.

20. The display driving method as claimed in claim 16, wherein after determination, if a data difference between the center sub-pixel unit and the first sub-pixel unit is greater than the edge threshold, a data difference between the center sub-pixel unit and the second sub-pixel unit is greater than the edge threshold, the pixel data of the center sub-pixel unit is smaller than the pixel data of the first sub-pixel unit, and the pixel data of the center sub-pixel unit is smaller than the pixel data of the second sub-pixel unit, the step of driving the center sub-pixel unit and the neighboring sub-pixel units in the map display unit according to the edge relationship comprises:

driving the first sub-pixel unit and the second sub-pixel unit to display the specified intensity map.

21. The display driving method as claimed in claim 16, wherein the center sub-pixel unit comprises a specific color sub-pixel, and after determination, if a data difference between the center sub-pixel unit and the first sub-pixel unit is greater than the edge threshold, the step of driving the center sub-pixel unit and the neighboring sub-pixel units in the map display unit according to the edge relationship comprises:

driving the center sub-pixel unit and the second sub-pixel unit to display the specified intensity map.

22. The display driving method as claimed in claim 16, wherein the center sub-pixel unit comprises a specific color sub-pixel, and after determination, if a data difference between the center sub-pixel unit and the second sub-pixel unit is greater than the edge threshold, the step of driving the center sub-pixel unit and the neighboring sub-pixel units in the map display unit according to the edge relationship comprises:

driving the center sub-pixel unit and the first sub-pixel unit to display the specified intensity map.

23. The display driving method as claimed in claim 16, further comprising:

writing the pixel data into the pixel array according to a data mapping method of a first rate.

* * * * *